US009855998B2

(12) United States Patent
Perosino et al.

(10) Patent No.: US 9,855,998 B2
(45) Date of Patent: Jan. 2, 2018

(54) STOWABLE BIMINI TOP

(71) Applicant: Commercial Sewing, Inc., Torrington, CT (US)

(72) Inventors: Gregory Perosino, Torrington, CT (US); Joseph Hamilton, III, Sweetwater, TN (US); Timothy Hamilton, Lenoir City, TN (US); David Mazzarelli, Torrington, CT (US); Michael Hissong, Torrington, CT (US); Brian DeLisle, Barkhamsted, CT (US)

(73) Assignee: COMMERCIAL SEWING, INC., Torrington, CT (US)

( * ) Notice: Subject to any disclaimer, the term of this patent is extended or adjusted under 35 U.S.C. 154(b) by 0 days.

(21) Appl. No.: 15/080,832

(22) Filed: Mar. 25, 2016

(65) Prior Publication Data

US 2016/0368570 A1 Dec. 22, 2016

Related U.S. Application Data

(60) Provisional application No. 62/109,449, filed on Jan. 29, 2015, provisional application No. 62/188,079, filed on Jul. 2, 2015.

(51) Int. Cl.
*B63B 17/02* (2006.01)

(52) U.S. Cl.
CPC ..... *B63B 17/02* (2013.01)

(58) Field of Classification Search
CPC ..... B63B 17/00; B63B 17/02; B63B 17/023; E04H 15/06; F16B 1/00
USPC ..... 114/361
See application file for complete search history.

(56) References Cited

U.S. PATENT DOCUMENTS

| | | | | |
|---|---|---|---|---|
| 4,951,594 | A * | 8/1990 | Feikema | B63B 17/02 114/361 |
| 7,392,758 | B2 * | 7/2008 | Metcalf | B63B 17/02 114/361 |
| 9,096,291 | B2 * | 8/2015 | Perosino | B63B 17/02 |
| 2006/0124045 | A1 * | 6/2006 | Tucker | B63B 17/02 114/361 |
| 2008/0223280 | A1 * | 9/2008 | Kemmer | B63B 17/02 114/361 |

* cited by examiner

*Primary Examiner* — Lars A Olson
(74) *Attorney, Agent, or Firm* — Cantor Colburn LLP

(57) ABSTRACT

A swing arm for a stowable bimini frame associable with a tower structure of watercraft is provided including a body associated with the bimini frame. The body is rotatable relative to the tower structure between a first position and a second position. An engagement mechanism selectively engages the body to retain the body in at least one of the first position and the second position.

26 Claims, 27 Drawing Sheets

STOWABLE BIMINI TOP

CROSS-REFERENCE TO RELATED APPLICATION

This application is related to and claims the benefit of U.S. Provisional Patent Application Ser. No. 62/109,449 filed on Jan. 29, 2015 and U.S. Provisional Patent Application Ser. No. 62/188,079 filed on Jul. 2, 2015, the entire contents of which are herein incorporated by reference.

FIELD

The disclosure relates generally to a bimini top, and more particularly to a stowable bimini top.

BACKGROUND

Stowing a bimini top for a tower structure that is associable with a watercraft can be difficult and inefficient from with respect to both time required and available storage space. Accordingly, a need exists in the art for a bimini top that can be easily and efficiently stowed.

SUMMARY

According to one embodiment of the invention, a swing arm for a stowable bimini frame associable with a tower structure of watercraft is provided including a body associated with the bimini frame. The body is rotatable relative to the tower structure between a first position and a second position. An engagement mechanism selectively engages the body to retain the body in at least one of the first position and the second position.

According to yet another embodiment of the invention, a stowable bimini top associable with a tower structure of a watercraft is provided including a first frame portion and a second frame portion. A hinge associates the first portion and the second portion. The bimini frame is configured to rotate relative to the tower structure between a first position and a second position.

According to yet another embodiment of the invention, a bimini top system for a watercraft is provided including a tower structure extruding from the watercraft. A stowable frame includes a first frame portion and a second frame portion. The stowable frame is configured to rotate relative to the tower structure between a first position and a second position.

According to yet another embodiment of the invention, a method of stowing a bimini top mounted to a tower structure of a watercraft is provided including unlocking the bimini top from a first position and rotated the bimini top from the first position to a second position.

DETAILED DESCRIPTION

Figure 2:
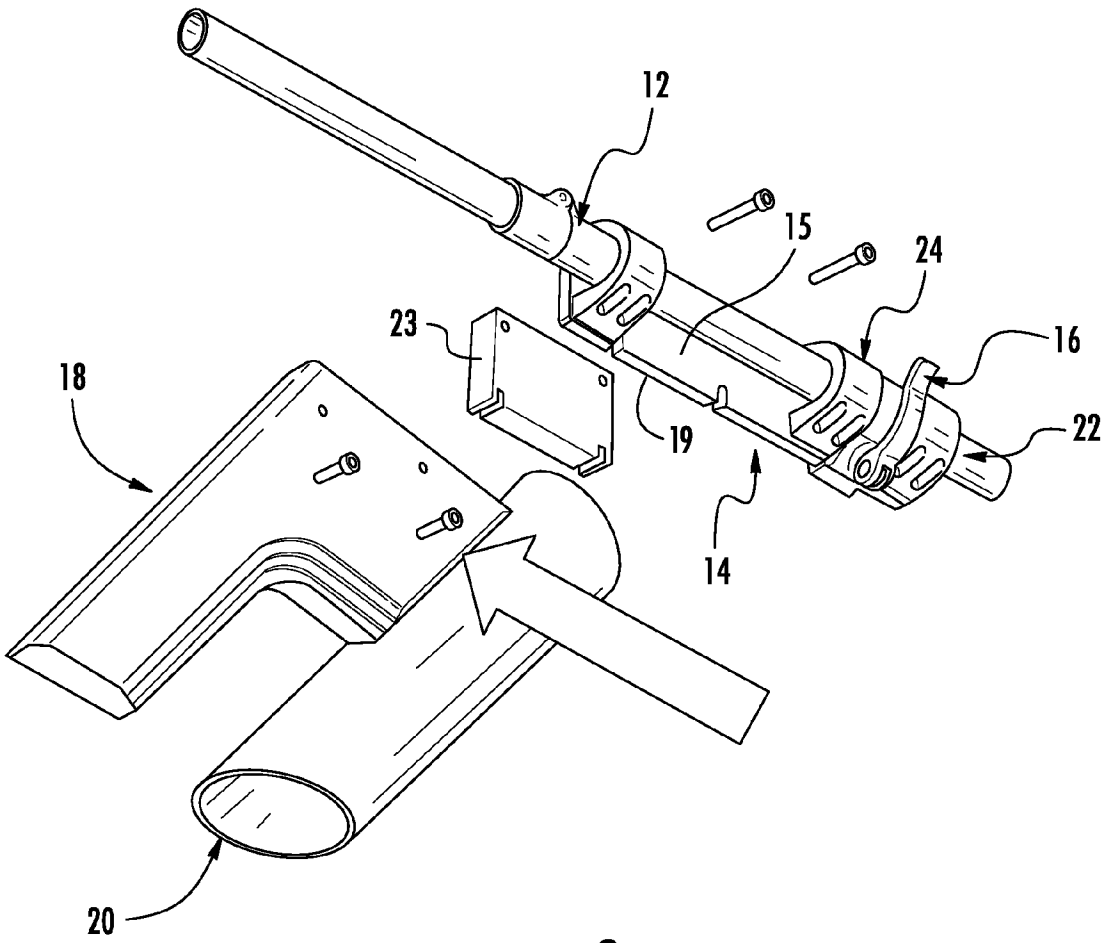
FIG. 2 is a schematic partial and exploded view of a hinge and slide area of the frame shown in FIG. 1, as well as a portion of a tower structure of a watercraft, according to an embodiment of the invention.

Referring now to the FIGS., an example of a bimini frame 10 that may fold and slide in a manner that allows a bimini top to be stowed against a tower/arch type structure mounted on any desirable style of watercraft 6, including, but not limited to a sport, ski, wakeboard, fishing, or other watercraft for example, is illustrated. As is best shown in FIG. 2, the frame 10 includes a hinge 12, slide piece 14, and cam locking device 16. These elements of the frame 10 allow the frame 10 to fold, slide, and lock in the manner alluded to above and discussed in greater detail below. Along with the frame 10, these elements may be made of any desirable material, such as but not limited to various metals and hard plastics. In addition, the frame 10 is typically equipped with a cover portion 17 (see FIGS. 3 and 4), such as formed from a canvas, plastic, or other suitable material for example, stretched around and across the bars of the frame 10 and secured via affixing mechanisms, including, but not limited to Velcro, snaps, and ties for example.

An example of the slide piece 14 is shown in the embodiment of FIG. 2. The illustrated slide piece 14 includes a slide piece body portion 15, which may be affixed to a portion of the boat tower structure, such as a handle 18 for example, at affixing surface 19 via any association means such as but not limited to mechanical fasteners 21. In the embodiment illustrated in FIG. 2, the body portion 15 is not directly affixed to the handle portion 18, as spacer 23 is disposed between the affixable surfaces of the handle 18 and the slide piece 14 to create a clearance there between. Of course, embodiments wherein the surface 19 of the slide piece 14 is directly affixed to the handle 18 and embodiments wherein some or all of the handle 18, slide piece 14, and/or spacer 23 elements are of unitary construction with each other are also within the scope of the invention.

Figure 1:
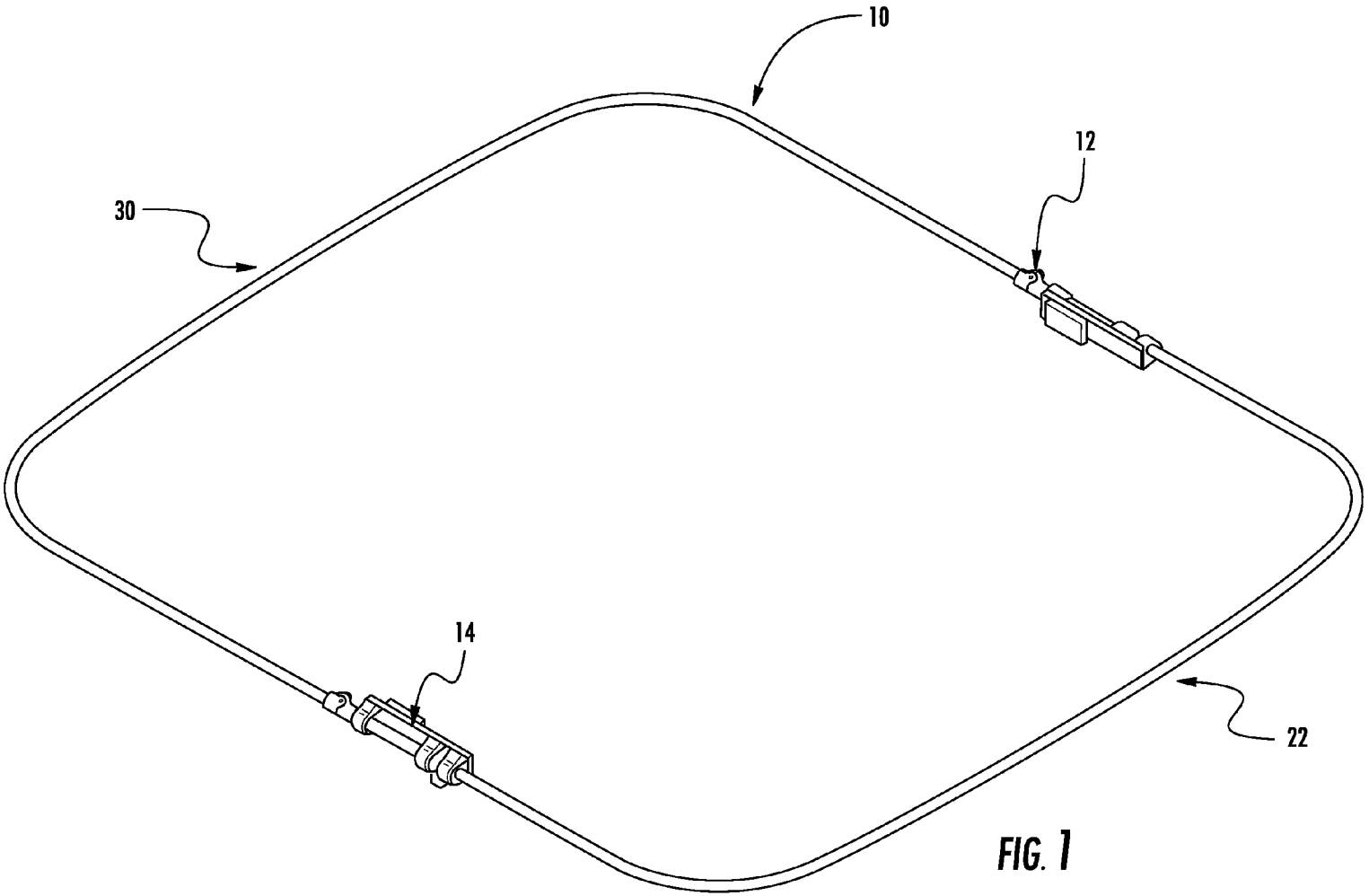
FIG. 1 is a perspective view of schematic bimini frame in an open position according to an embodiment of the invention.
Figure 3:
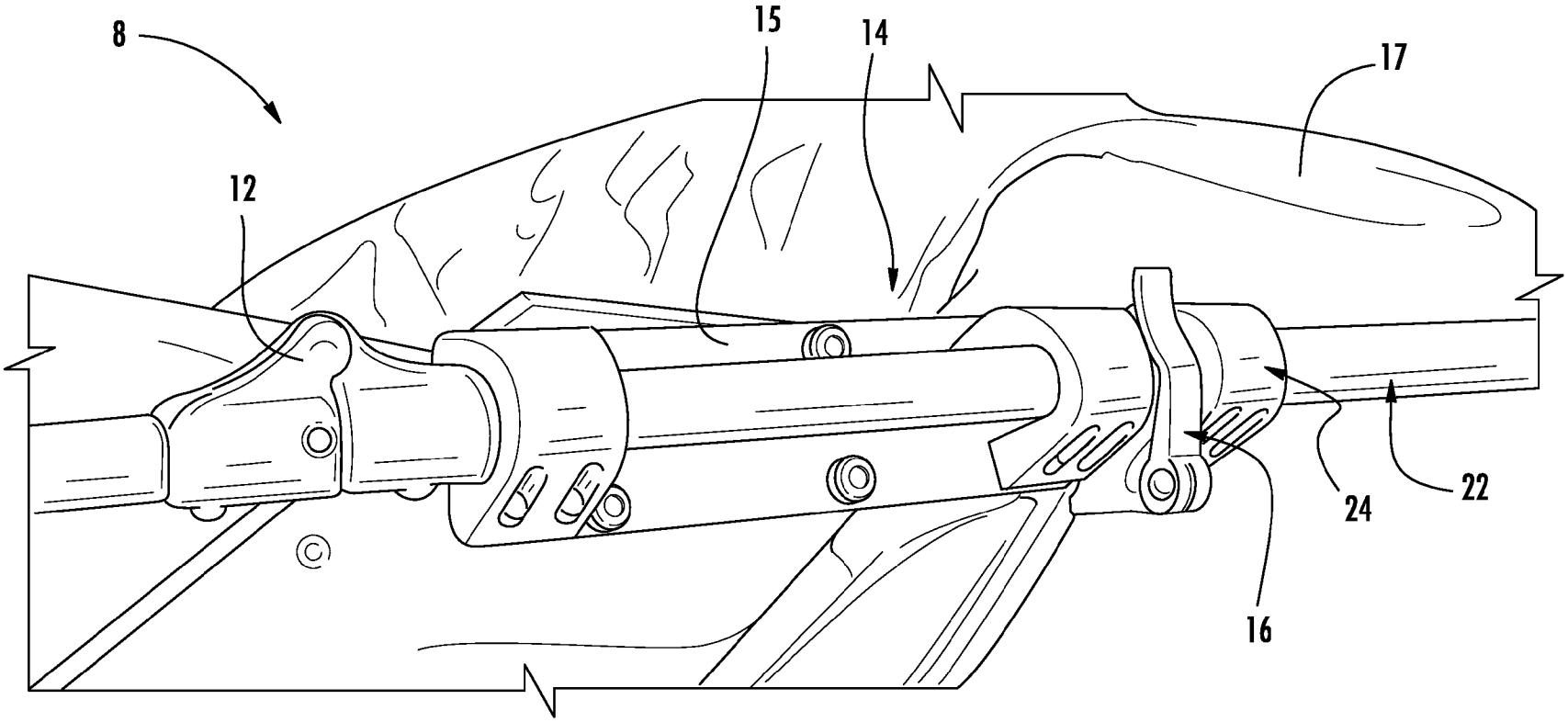
FIGS. 3-9 are various partial and full perspective views of a bimini top shown positions intermediate to the open position shown in FIG. 1 and a stowed position, according to an embodiment of the invention.
Figure 4:
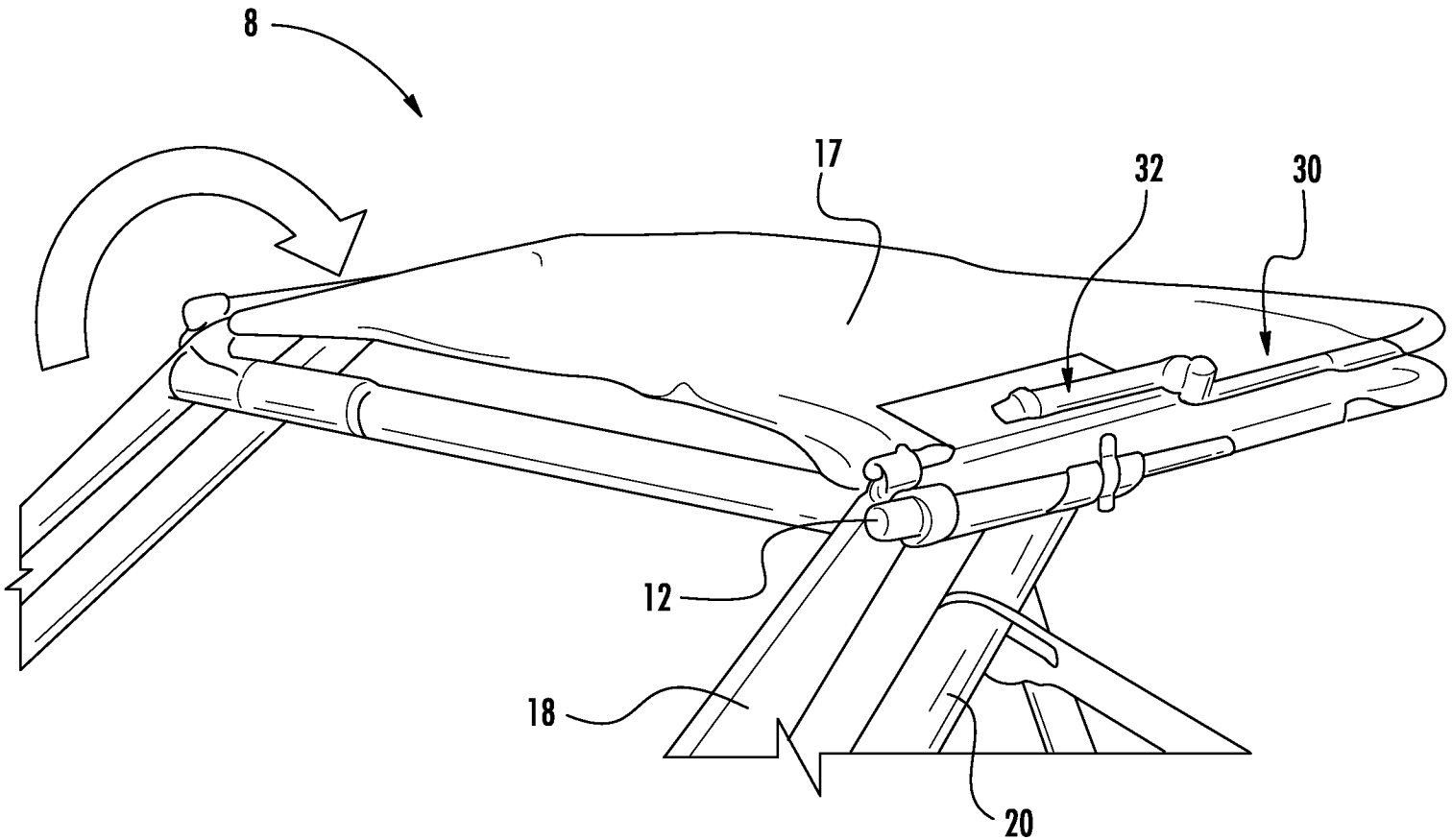

As shown in the FIGS., the frame 10 includes a relatively front portion 22 and a relatively rear portion 30, defined by the hinge 12. The front portion 22 of the frame 10 is associated with the slide piece 14 via frame association structures or slide parts 24. These slide parts 24 may be affixed to the body 15 of the slide piece 14 via any association means such as but not limited to mechanical fasteners, welding, and unitary construction. In use, the slide parts 24 of the piece 14 may be covered with a protective cover of similar material to the piece 14. When the frame 10 of the bimini top is in an open position as shown in FIGS. 1 and 3, the cams 16 are locked so as to prevent the front portion 22 (and frame 10 in general) from sliding relative to the slide piece 14 and the tower structure 20 to which the slide piece 14 is affixed. In addition, when the bimini top is in the open position, the cover portion 17 thereof, if supported not only by the front portion 22 and the rear portion 30 of the frame, but also by the free end of the tower structure 20 which is configured to keep the material of the cover portion 17 taut. The front portion 22 and back portion 30 of the frame 10 may also be locked in this open position at the hinge 12.

Figure 5:
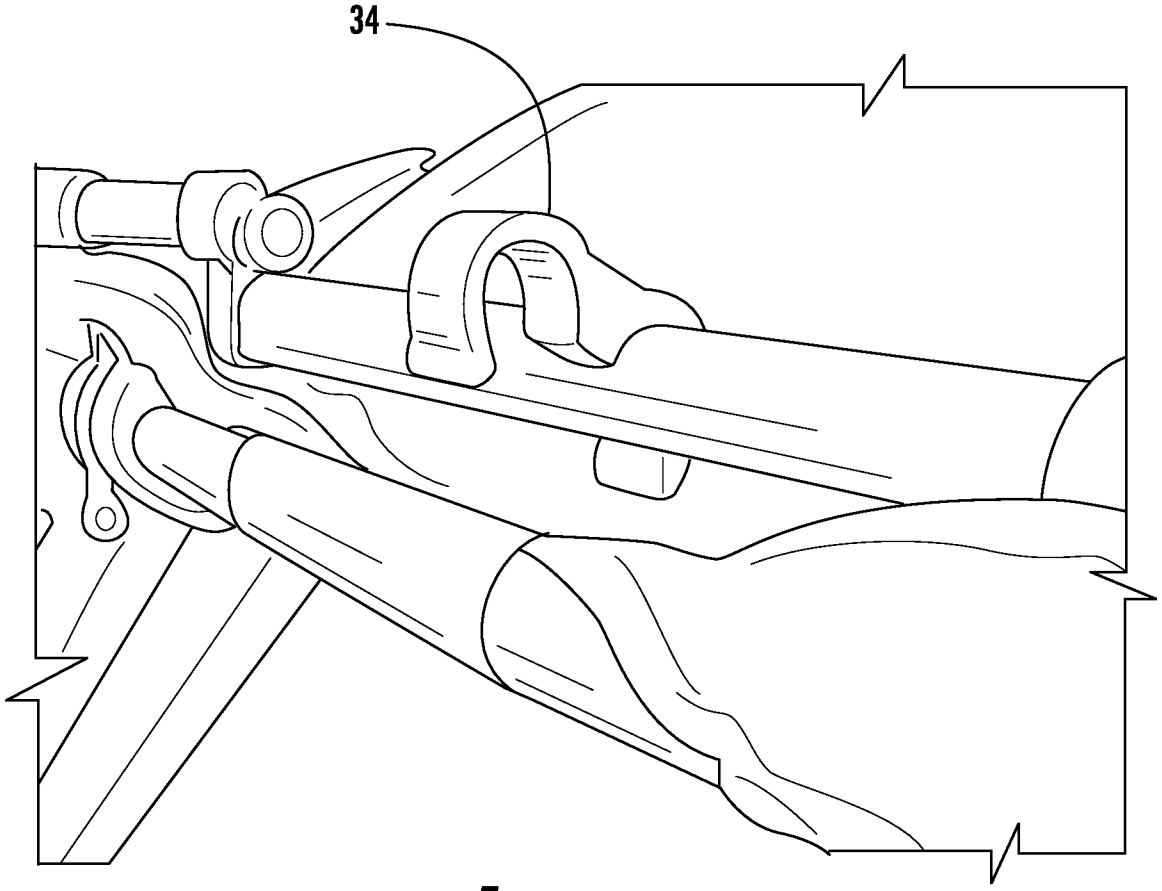
Figure 6:
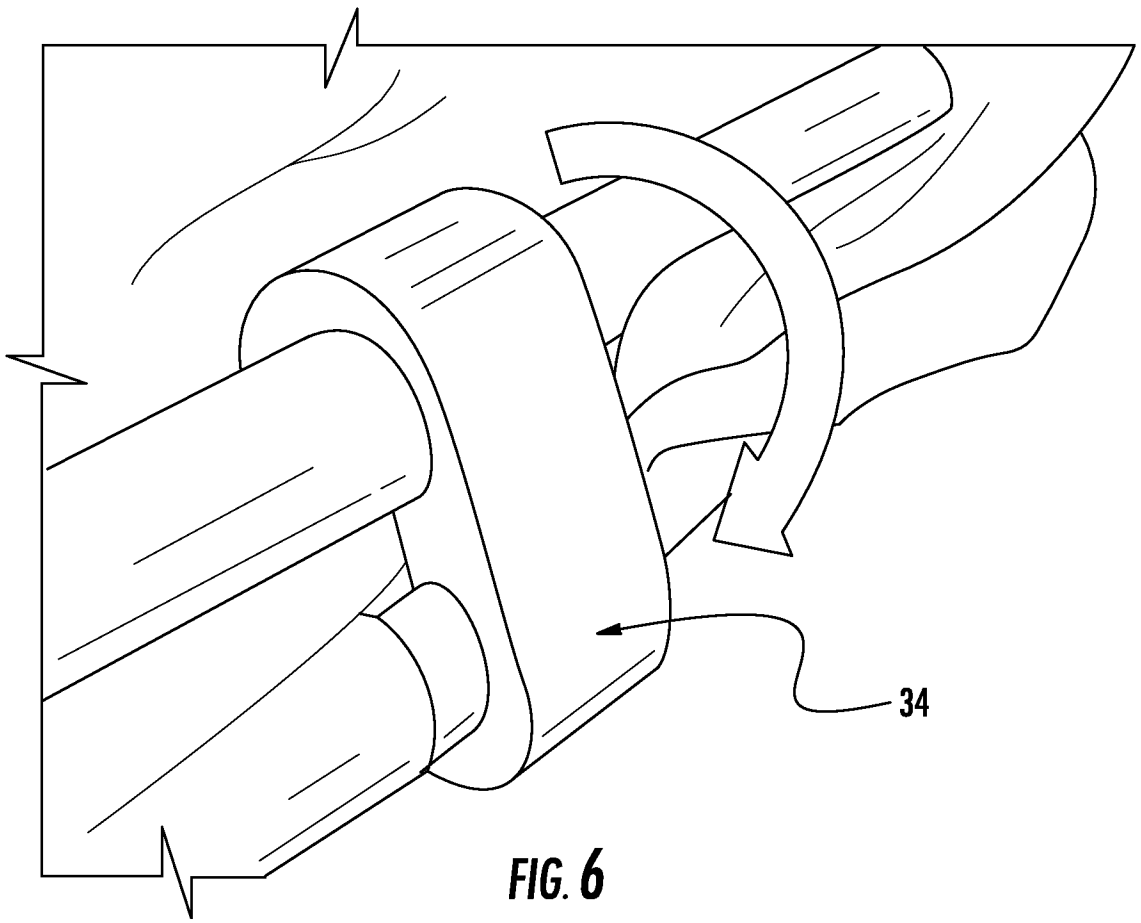
Figure 7:
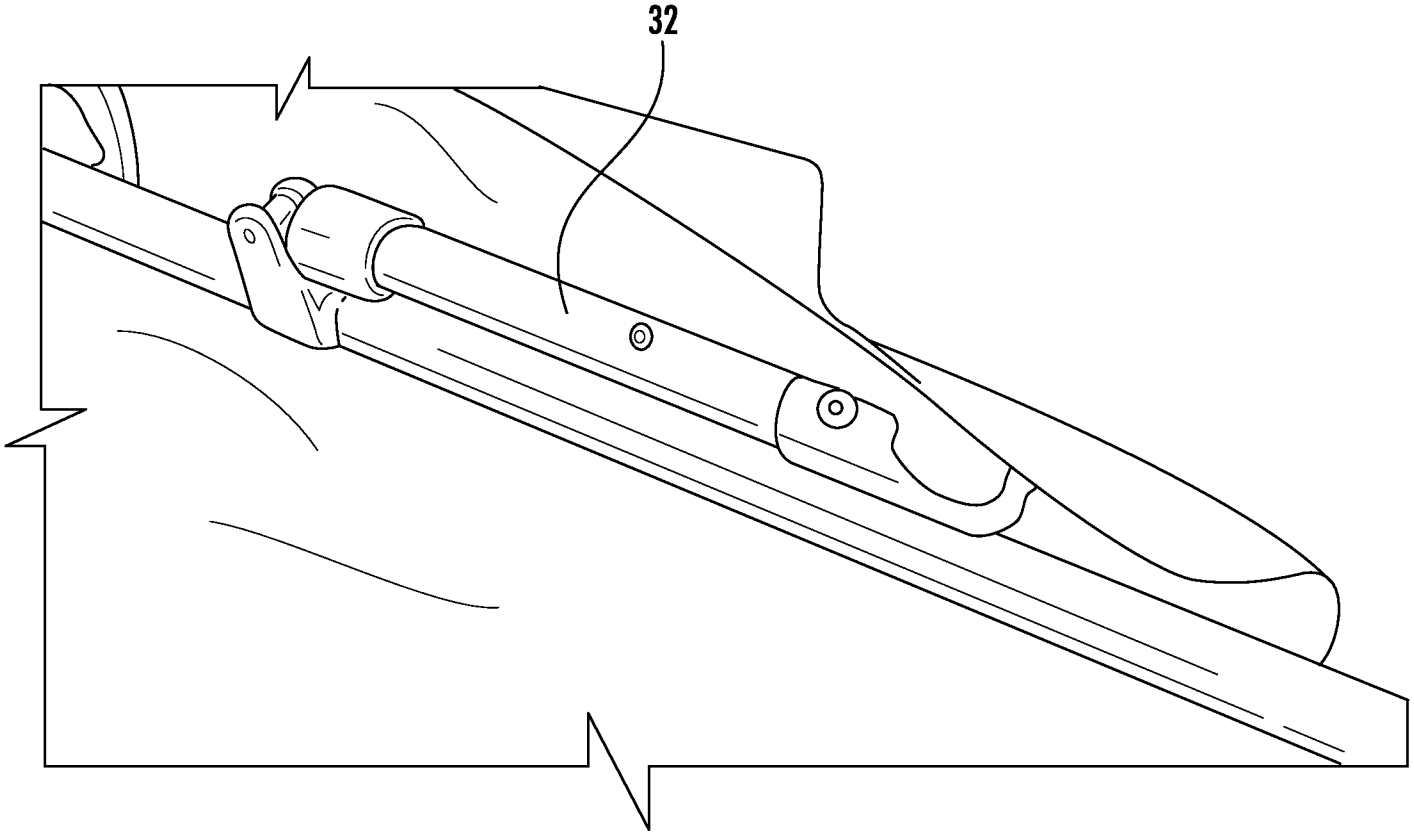

As is best shown which illustrates an upper portion of a bimini top system 8 (including the frame 10 and a portion of the tower structure 20 mounted to and extending from a deck or other surface of a watercraft 6), the back portion 30 of the frame 10 may be moved towards a folded (and eventually stowed) position by folding the frame 10 at hinge 12. This is achieved by disengaging rear legs 32 from the tower structure 20 and folding the back portion 30 of the frame 10 (which is fully locked against sliding in a forward position by the cams 16) upwards and onto the front portion 22. As is best shown in FIGS. 5-7, the front and back portions 22, 30 of the frame 10 may then be clipped together via clips 34, and the back legs 32 may be stored under Velcro flaps.

Figure 8:
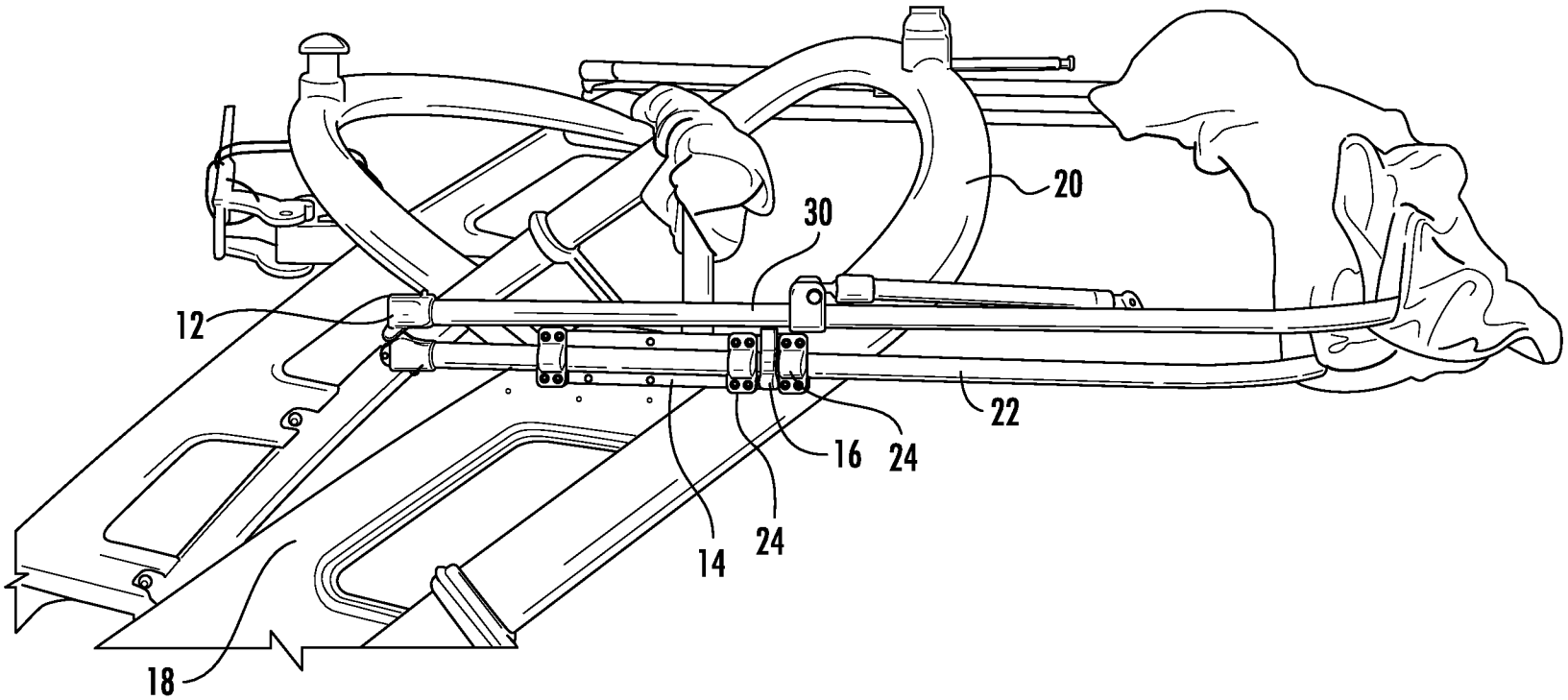
Figure 9:
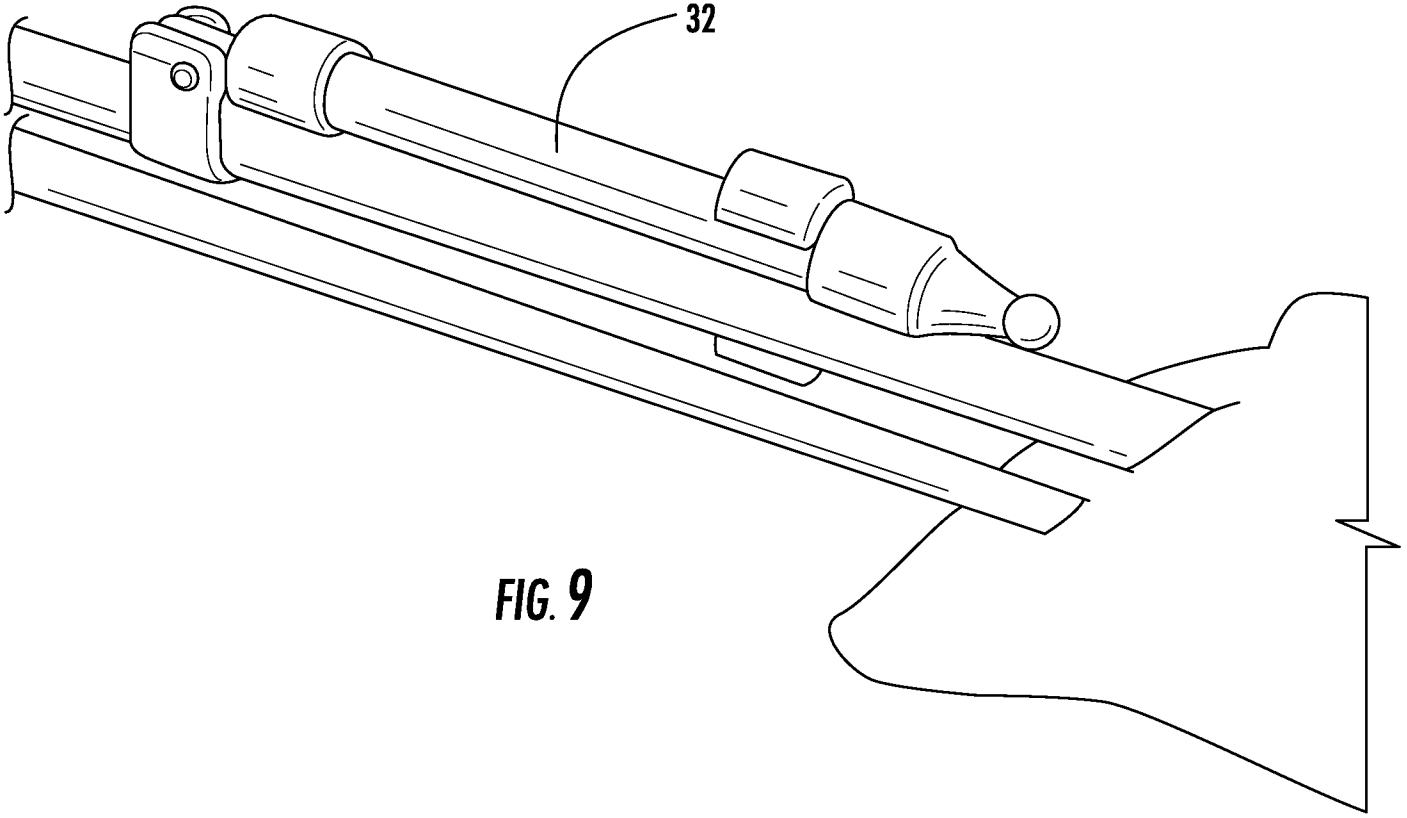
Figure 10:
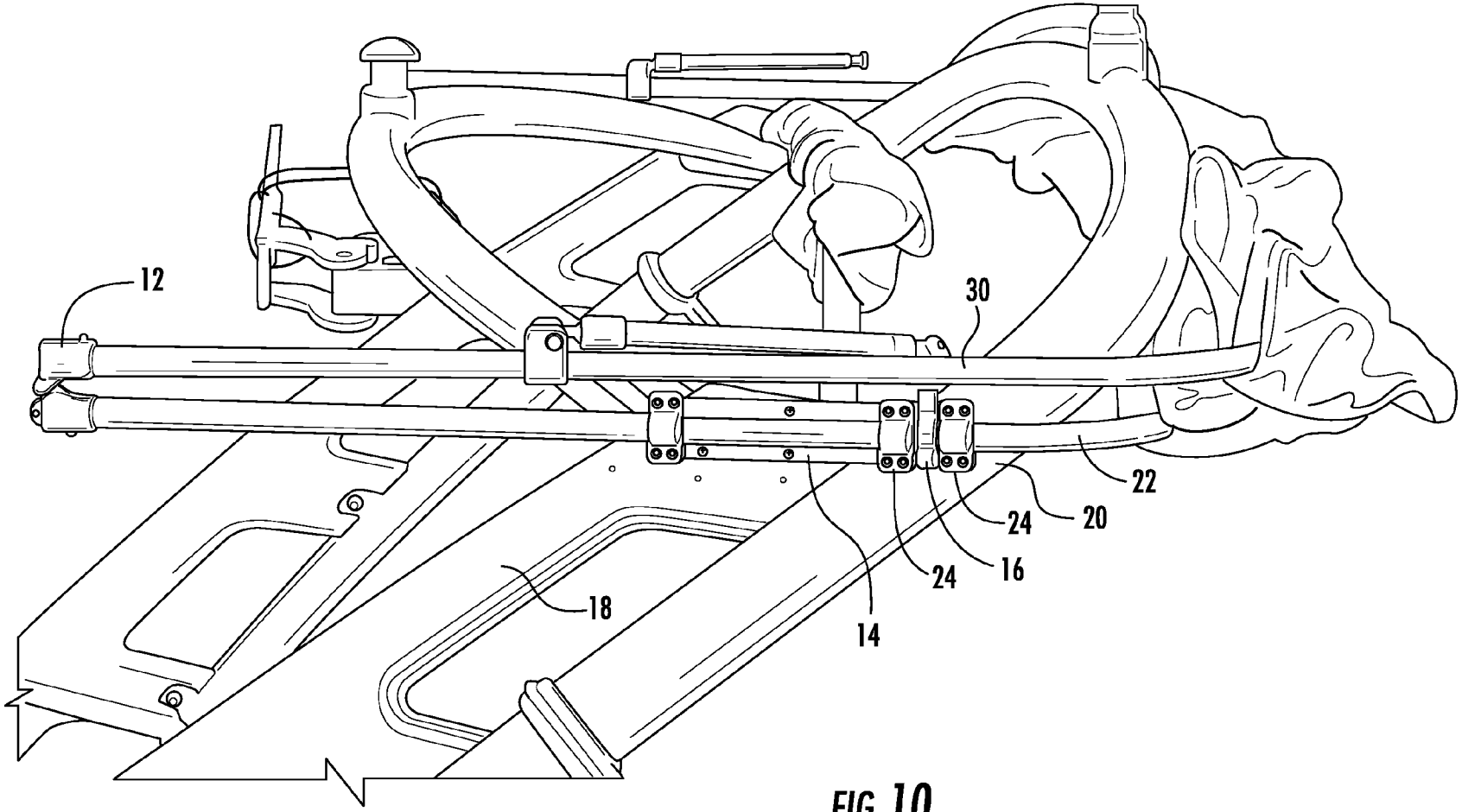
FIG. 10 is a perspective view of a bimini in a stowed position according to an embodiment of the invention.

Referring now to FIGS. 8-10, the fully folded frame 10 (which remains locked against sliding via cams 16 in FIG. 8 is positioned for sliding into a first stowed position. This first stowed position is shown in FIG. 10, wherein the folded front and back portions of the frame 10 are slid backwards from the folded position of FIG. 9 to the first stowed position. This sliding occurs by first unlocking the cams 16, and then sliding the front portion 22 of the frame 20 backwards through the slide parts 24. As the slide parts 24 are in a fixed position relative to the tower structure 20 (via the affixing of the slide piece 14 to the tower 20), the sliding of the front portion 22 moves the frame 10 backward relative to the tower structure 20, and into the folded, slid, and first stowed position shown in FIG. 10. The cams 16 are then again locked to prevent the frame 10 from sliding out of the first stowed position.

Figure 11:
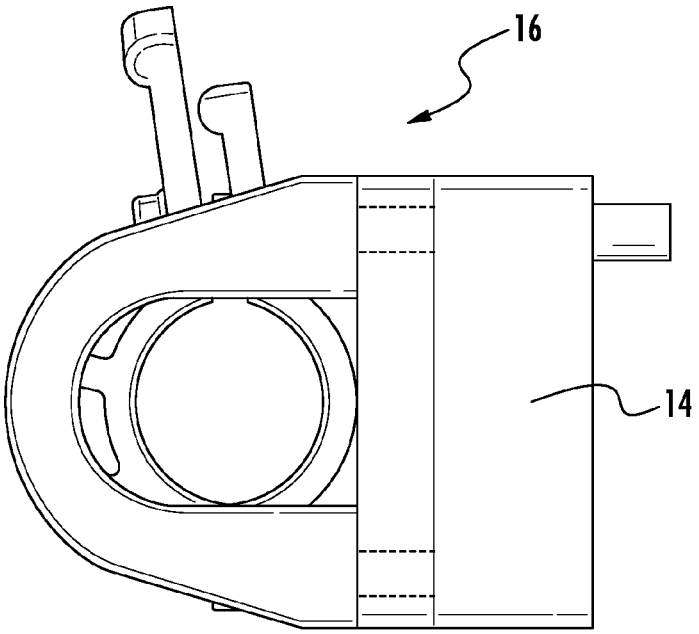
FIG. 11 is an enlarged end view of the slide piece shown in FIG. 1 as configured in a first, unlocked configuration according to an embodiment of the invention.
Figure 12:
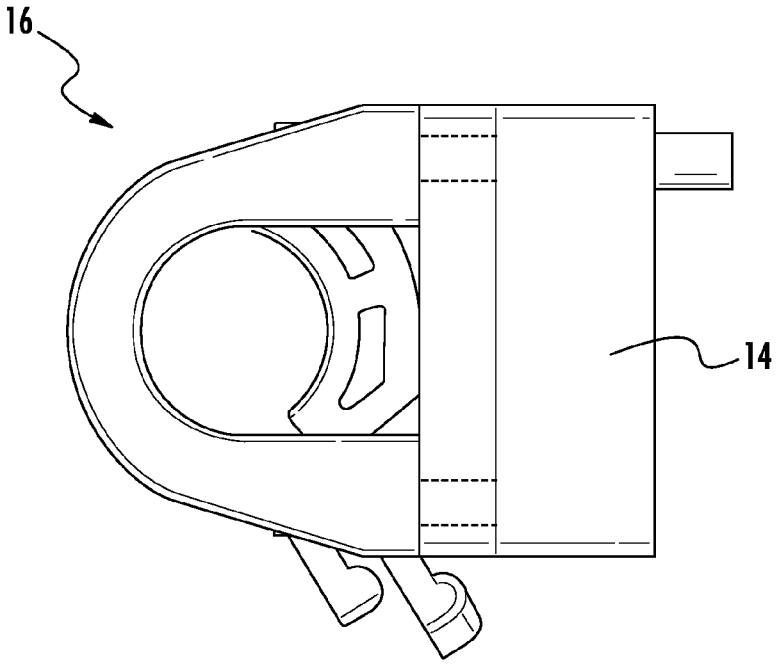
FIG. 12 is an enlarged end view of the slide piece shown in FIG. 1 as configured in a second, locked configuration according to an embodiment of the invention.
Figure 13:
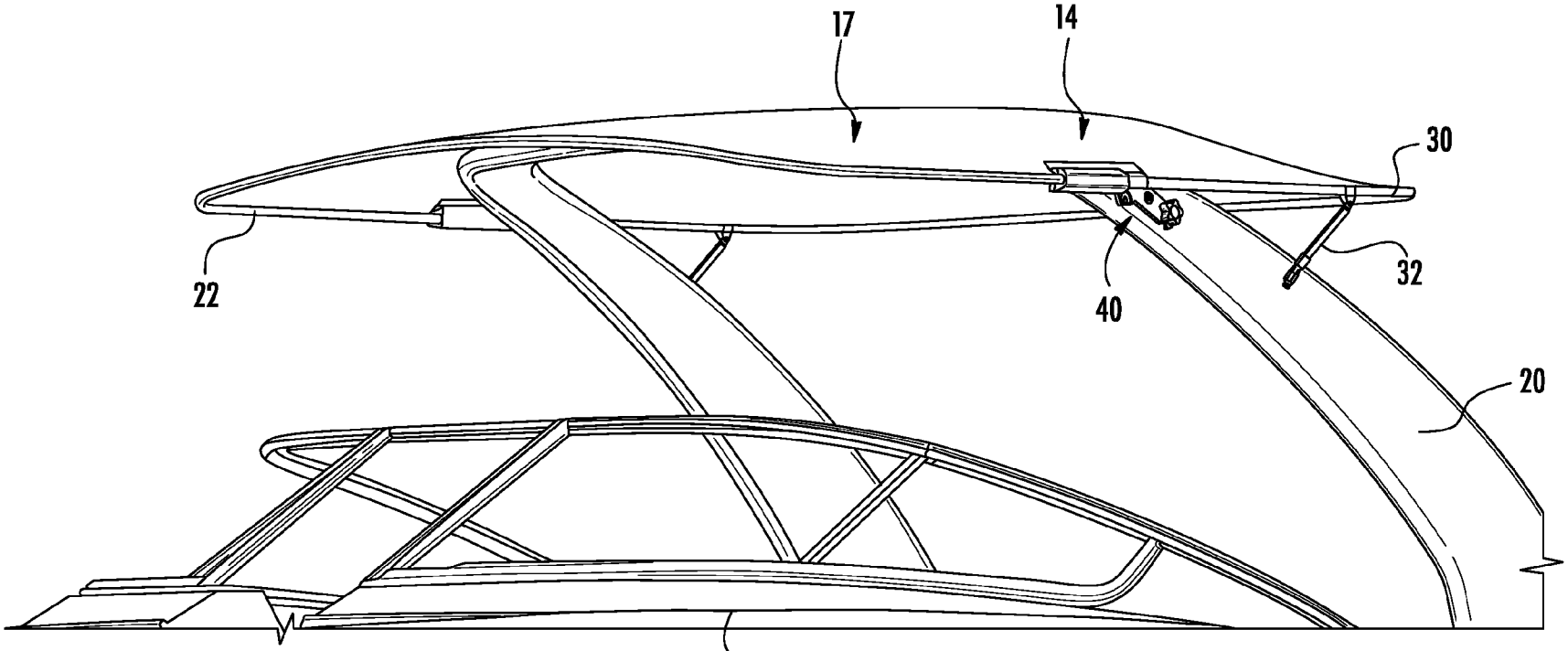
FIG. 13 is a perspective view of a watercraft having a bimini top system in an open configuration according to an embodiment of the invention.
Figure 14:
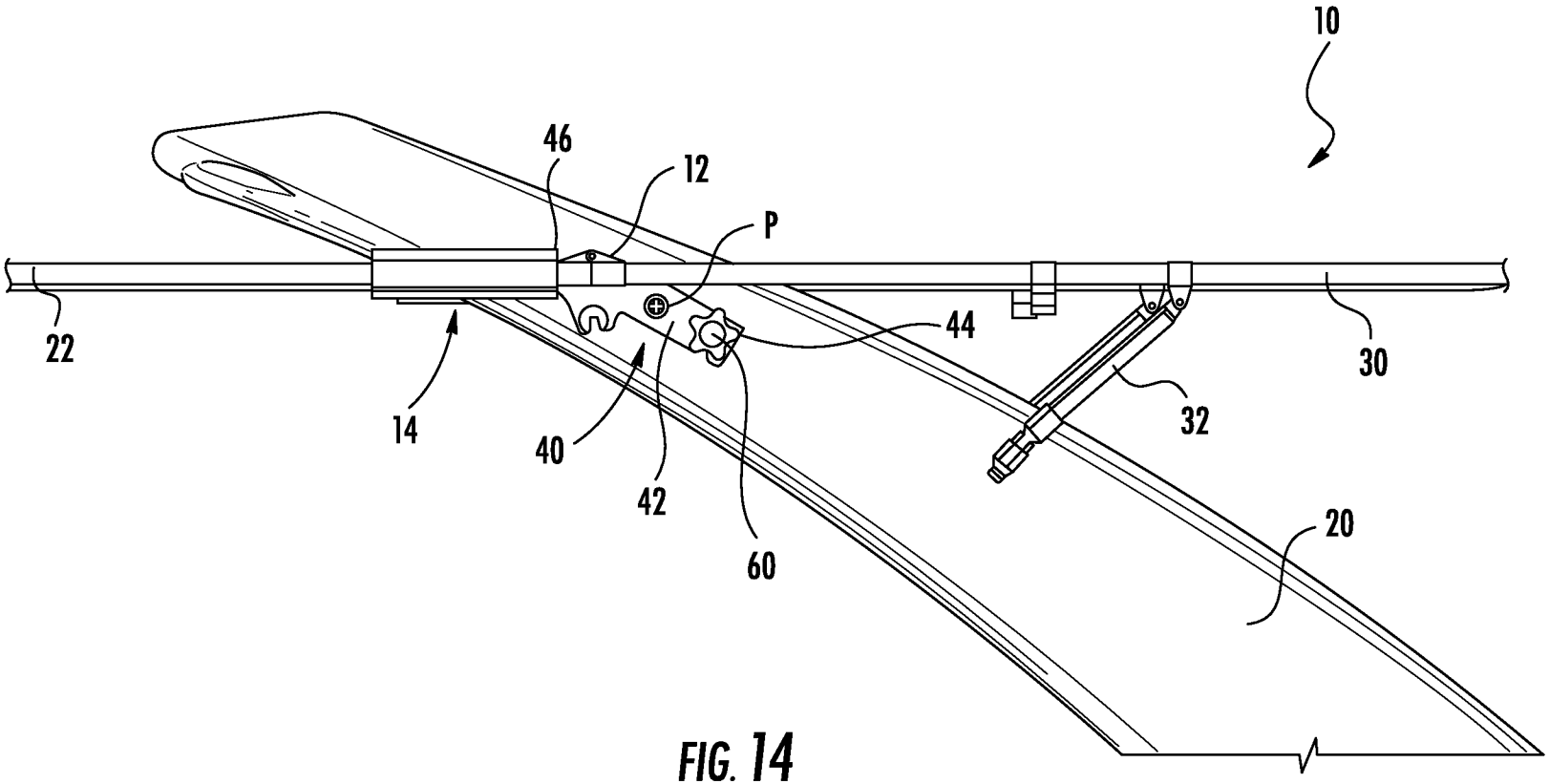
FIG. 14 is a side view of a rotation assembly of a bimini top system in an open position according to an embodiment of the invention.

Referring now to FIGS. 11 and 12, another embodiment of the slide piece 14 and cam 16 is shown. In FIG. 11, the slide piece 14 and cam 16 are shown in an unlocked configuration. In this unlocked configuration, a clearance is present between the front portion 22 of the frame 10 and the innermost walls of the slide piece 14. In one embodiment, this clearance is at least ⅜ of an inch on either lateral side of the frame bar.

In FIG. 12, the slide piece 14 and cam 16 are shown in a locked configuration. In this locked configuration, the cam 16 is positioned in a manner that biases the frame bar towards and into contact with one of the walls (the wall away from slide piece connection with the handle 18 in the embodiment of FIG. 12), causing the bar to traverse and close the clearance that is present on one side of the bar when in the open position of FIG. 11. The bias caused by the above discussed locking (or any other desirable locking mechanism) is designed to hold the frame 10 in position while traveling at any acceptable speeds of highway or water transportation.

While the front and back portions of the frame 10 are shown to be "U" shaped in the embodiment illustrated in FIG. 1, it should be appreciated that the frame 10 may include any shape conducive to use with any known tower configuration. In addition, though the sliding of the frame 10 is shown to occur through the slide parts 24 in the illustrated embodiments of FIGS. 2-10, it should be appreciated that this sliding may occur via any known mechanical mechanism, such as but not limited to telescoping portions and additional hinges.

Figure 15:
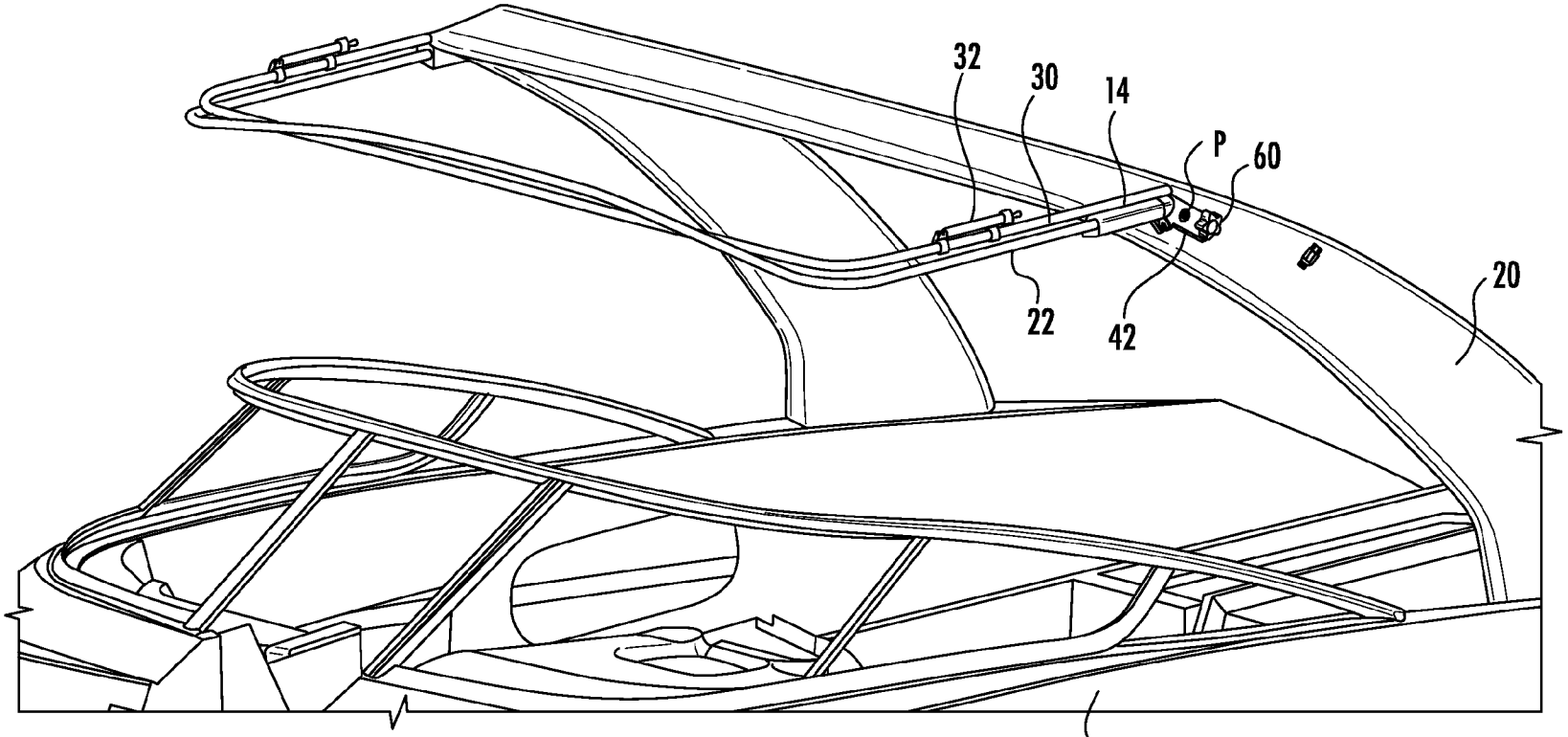
FIG. 15 is a perspective view of a rotation assembly of a bimini top system in a folded position according to an embodiment of the invention.
Figure 16:
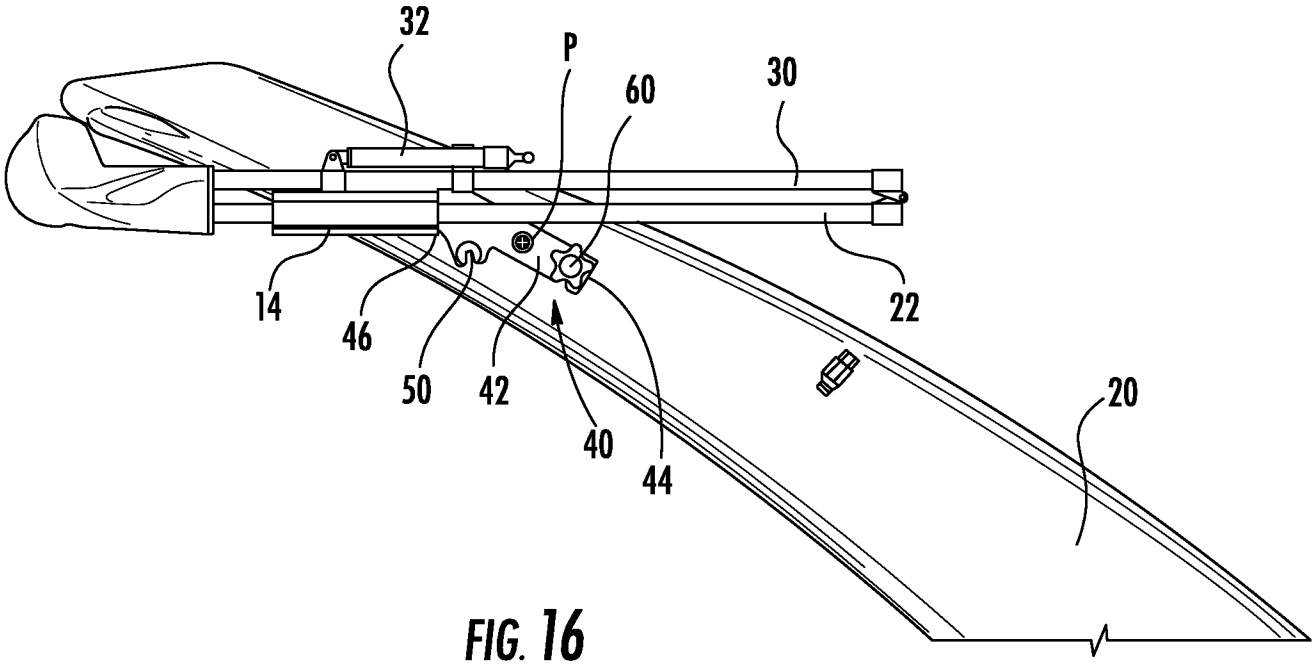
FIG. 16 is a side view of a rotation assembly of a bimini top system in a stowed position according to an embodiment of the invention.
Figure 17:
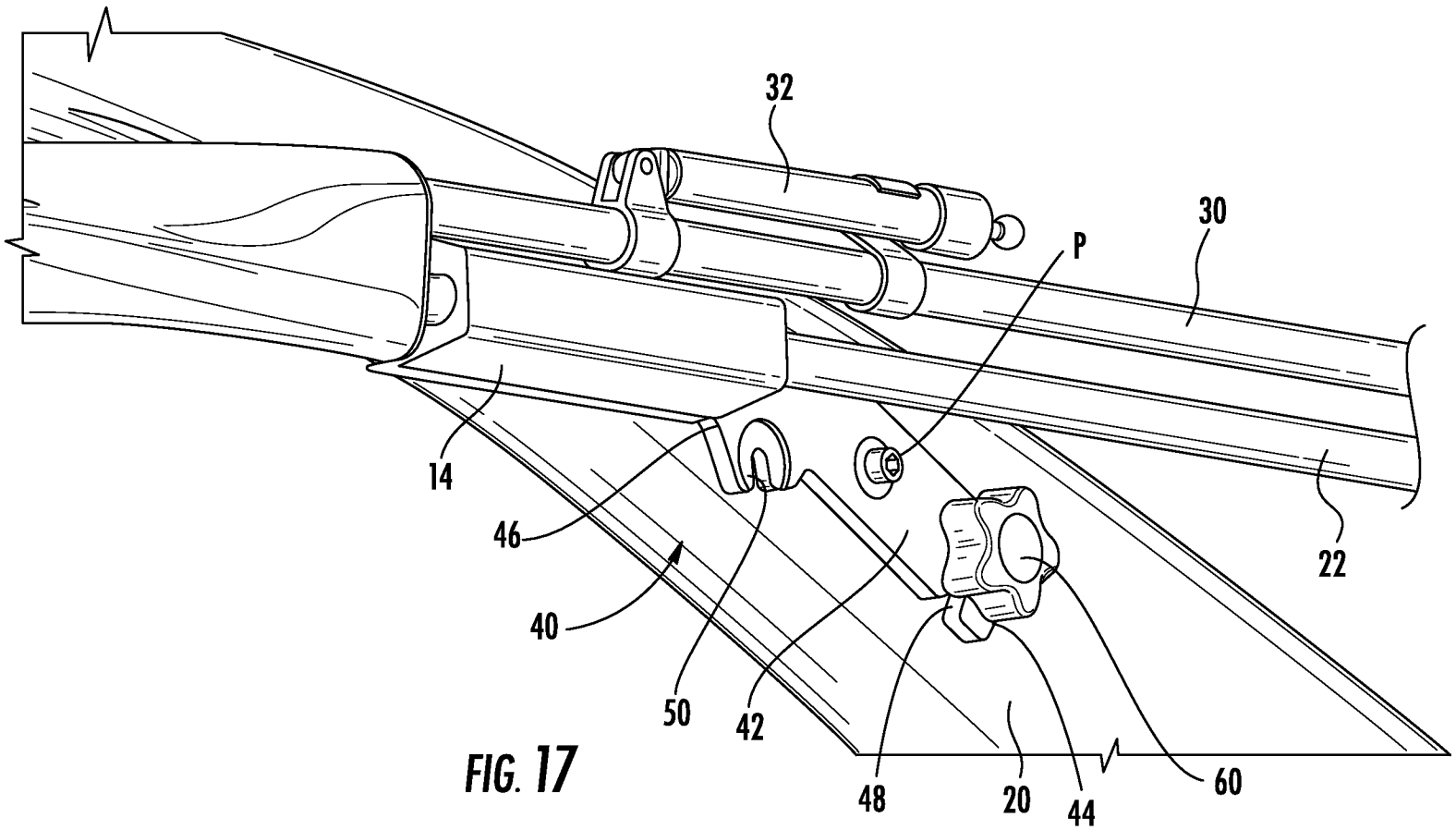
FIG. 17 is a detailed view of a rotation assembly of a bimini top system according to an embodiment of the invention.
Figure 18:
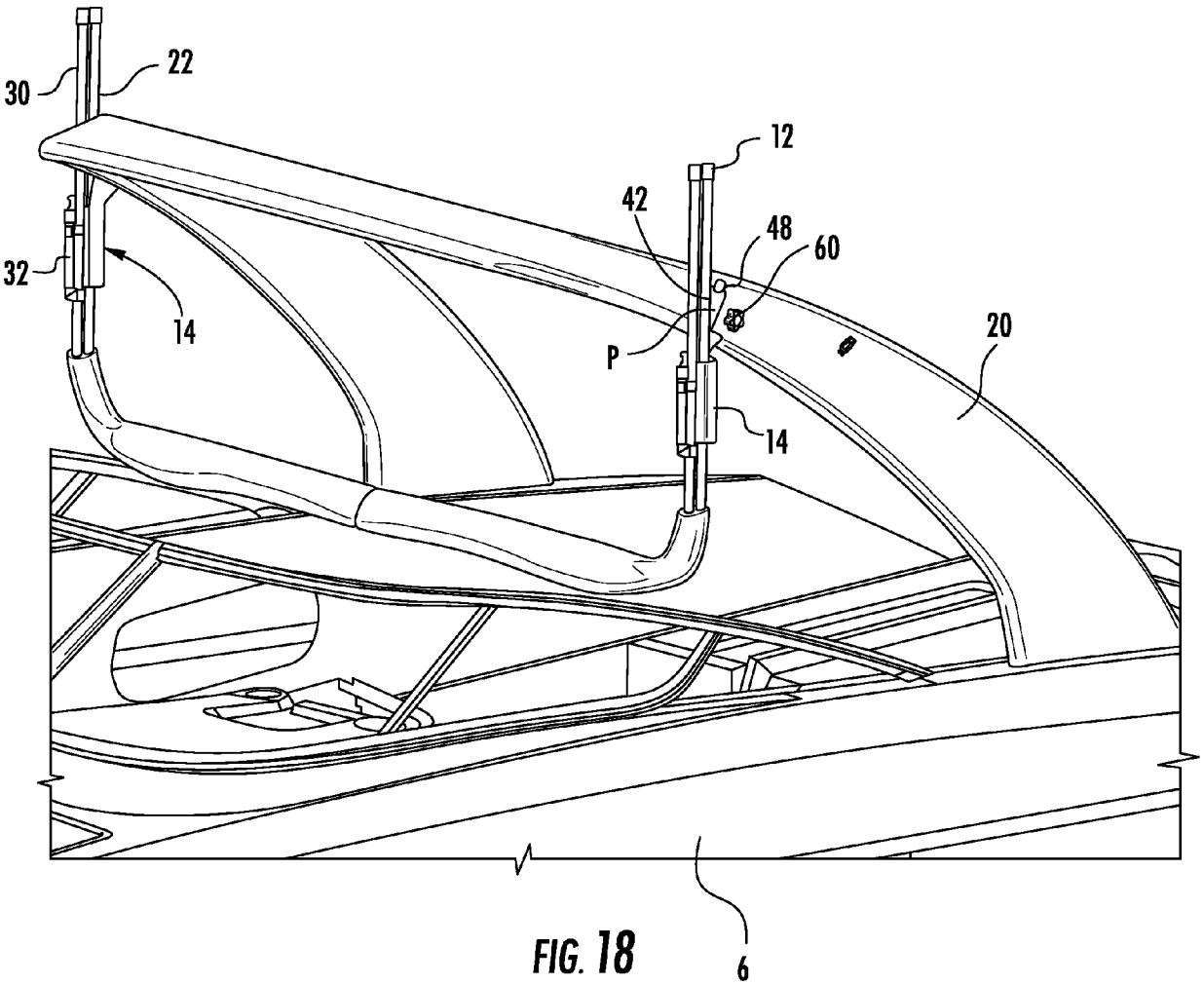
FIG. 18 is a perspective view of a bimini top system in a position intermediate to the folded position and another stowed position according to an embodiment of the invention.
Figure 19:
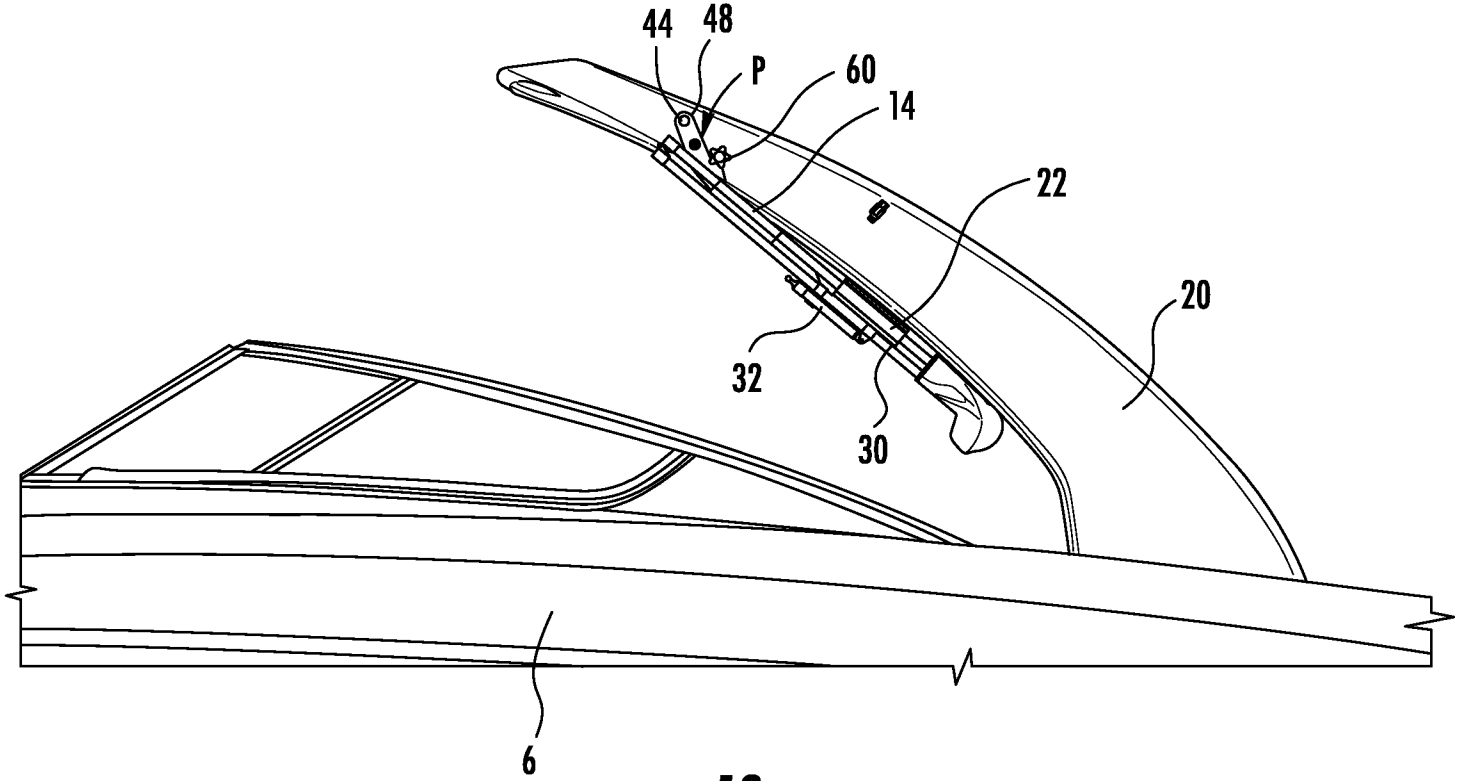
FIG. 19 is a side view of a watercraft having a bimini top system in a stow position according to an embodiment of the invention.

Referring now to FIGS. 13-27, the bimini top is additionally configured to rotate relative to the tower structure 20 to provide enhanced storage capability. An assembly 40 to provide said rotation generally includes swing arm 42 operably coupled to the slide piece 14 and to a portion of the tower structure 20, such as a side surface thereof, adjacent the handle for example. The swing arm 42 is pivotable about an axis defined by a pin P to move the bimini top and frame 10 between an extended first position (FIG. 15), and a rotated second position (FIG. 19).

An engagement mechanism 60 is configured to cooperate with the swing arm 42 to limit movement of the swing arm 42 from at least one of the first position and the second position. As shown, the swing arm 42 may include a first connector 48 and/or a second connector 50, generally complementary to the engagement mechanism 60. In one embodiment, the engagement mechanism 60 is configured to engage the first connector 48 when the swing arm 42 is in the first position and the second connector 50 when the swing arm 42 is in the second position such that the engagement mechanism 60 is selectively retains the swing arm 42 in each of the first position and the second position, respectively. The engagement mechanism 60 may be a fastener, as shown in FIGS. 13-20, or a spring pin, as shown in FIGS. 21-28. However, various other engagement mechanisms, such as a latch, stanchion, marine hardware or strap for example, are also within the scope of the disclosure.

Referring now to the non-limiting embodiment illustrated in FIGS. 13-20, a first configuration of the assembly 40 is illustrated in more detail. As shown, the affixing surface 19 of the slide piece body 14 is directly attached to a portion of the swing arm 42, such as adjacent an end 46 thereof. The first connector 48 and the second connector 50 may be formed in generally the same side of the swing arm 42, adjacent opposite ends 44, 46 of the arm 42, respectively. The first connector 48 may include an elongated first slot formed near end 46 and the second connector 50 may include an elongated second slot formed near the end 44. The first connector 48 and the second connector 50 may, but need not be, substantially identical in size and shape.

In the illustrated embodiment, the engagement mechanism 60 is a fastener threadably connected to the tower structure 20 and slidably received within the first and second connectors 48, 50. In such instances, a head of the fastener 60 is larger than the first and second connector 48, 50 such that by tightening the fastener, the swing arm 42 is compressed against the tower structure 20, thereby preventing rotation of the arm 42.

In another embodiment, illustrated in FIGS. 21-24, the swing arm 42 is connected to the tower structure 20 via a mounting bracket 54. The swing arm 42 includes a first end 44 and an elongated portion 56 arranged adjacent a second end 46 such that the first end 44 and the second end 46 are at an angle to one another. The slide piece 14 may be integrally formed with the elongated portion 56 of the swing arm 42. As shown, the elongated portion 56 of the swing arm 42 includes a plurality of openings configured to receive one or more frame association structures 24 such that the frame 10 is limited to sliding movement relative to the swing arm 42. As previously described, a first connector 48 and a second connector 50 are formed in the swing arm 42. In one embodiment, the swing arm 42 additionally includes a protrusion 58 configured to contact a portion of the mounting bracket 54 to restrict rotation of the swing arm 42 relative to the mounting bracket 54 in a first direction beyond the first, generally horizontal position.

In the illustrated, non-limiting embodiment, the engagement mechanism 60 includes a spring-loaded pin and is connected to a portion of the mounting bracket 54 adjacent an end 44 of the swing arm 42. In such embodiments, the engagement mechanism 60 is biased into engagement with one of the first connector 48 and the second connector 50. As a result, the swing arm 42 is retained in either the first or second position until being manually released from the engagement mechanism 60, such as by applying a force in a direction opposing the biasing force thereof.

With reference now to FIGS. 25-28, in yet another embodiment, the swing arm 42 coupled to the mounting bracket 54 has a generally linear configuration. A first end 44 of the swing arm 42 is pivotally connected to the mounting bracket 54, such as with a bumper bolt P for example. As shown, the swing arm 42 is configured to function as the slide piece body 14 and receive one or more frame association structures 24 such that the frame 10 is slidably coupled to the swing arm 42. In the illustrated, non-limiting embodiment, a connecting plate 57 having the first connector 48 and second connector 50 formed therein is mounted to a portion of the swing arm 42, opposite the frame association structures 24. However, in other embodiments, the connecting plate 57 may be integrally formed with the swing arm 42.

Similar to the embodiment of FIGS. 21-24, the engagement mechanism 60 includes a spring-loaded pin and is connected to a portion of the mounting bracket 54 adjacent the connecting plate 57. In such embodiments, the engagement mechanism 60 is biased into engagement with one of the first connector 48 and the second connector 50. In the illustrated, non-limiting embodiment, a curved or arcuate slot 62 is formed in the side of the swing arm 42 facing the mounting bracket 54. A pin (not shown) extending from the mounting bracket 54 is received within the slot 62 and is configured to limit rotation of the swing arm 42 relative to the mounting bracket 54, and therefore the tower structure 20.

With reference to all of the embodiments illustrated in FIGS. 13-28, when the swing arm 42 is in the first position, the engagement mechanism 60 is in contact with the first connector 48. In the first position, the frame 10 is oriented generally horizontally and may be arranged in any one of an open position, folded position, or first stowed position. When the swing arm 42 is in the second position, the engagement mechanism 60 is in contact with the second connector 50 and the frame 10 is rotated relative to horizontal.

Referring again to FIGS. 14-17, the fully folded frame 10, (which remains locked against sliding via cams 16) is positioned for rotating to a second stowed position. In the illustrated, non-limiting embodiment, a boot or other case 64 is positioned about the front end 11 of the folded frame 10 and is configured to neatly store the cover portion 17 attached to the frame 10. The frame 10 is moved to the second stowed position by rotating the swing arm 42 from the first position to the second position. This rotating occurs by first unlocking the swing arm 42 from the engagement mechanism 60 and then by pivoting the swing arm 42 from the first position to the second position. Once the swing arm 42 is in the second position, the engagement mechanism 60 is locked to the swing arm 42, such as by tightening the mechanism 60 against the swing arm 42 for example, to prevent the frame 10 from rotating out of the second stowed positon.

Figure 20:
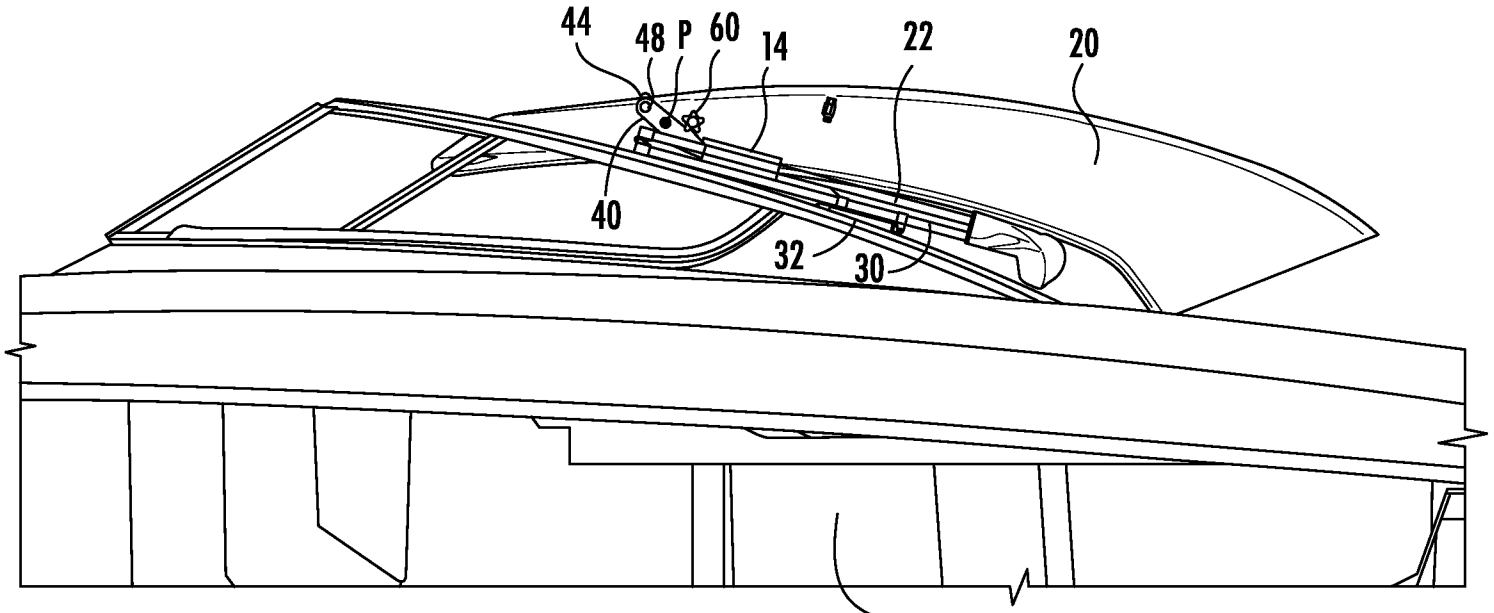
FIG. 20 is a side view of a watercraft having both a tower structure and a bimini top system arranged in a stowed configuration according to an embodiment of the invention.
Figure 21:
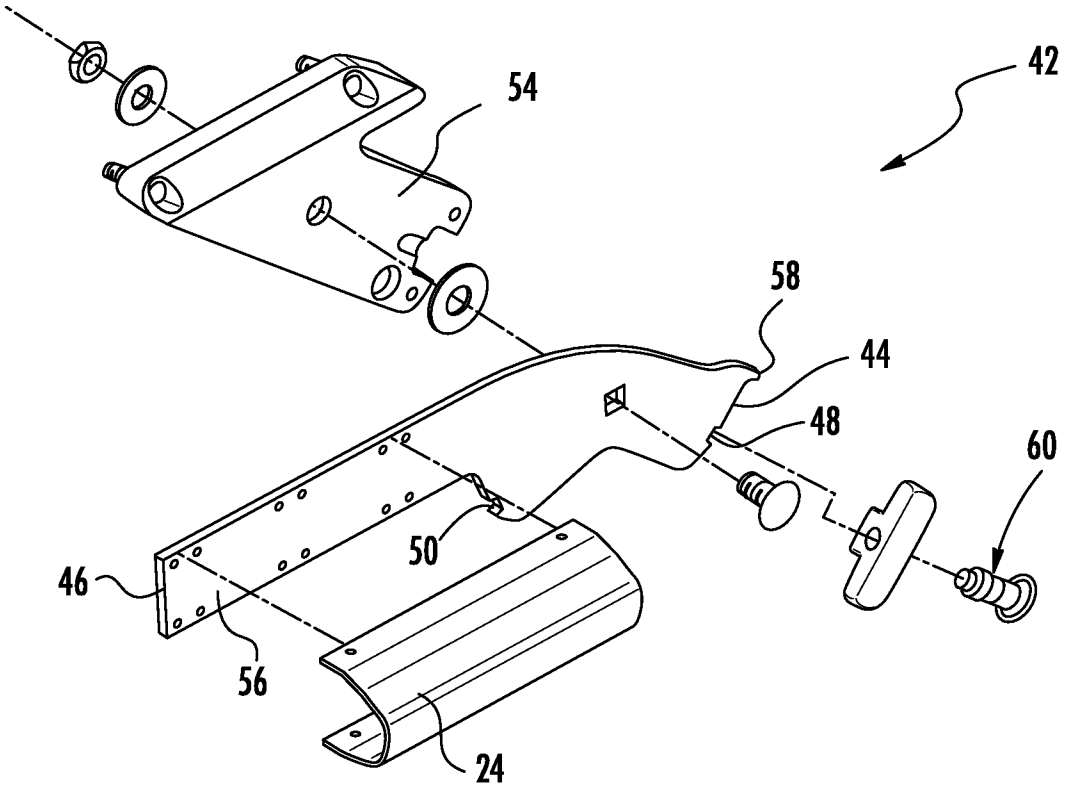
FIG. 21 is an exploded perspective view of another rotation assembly according to another embodiment of the invention.
Figure 22:
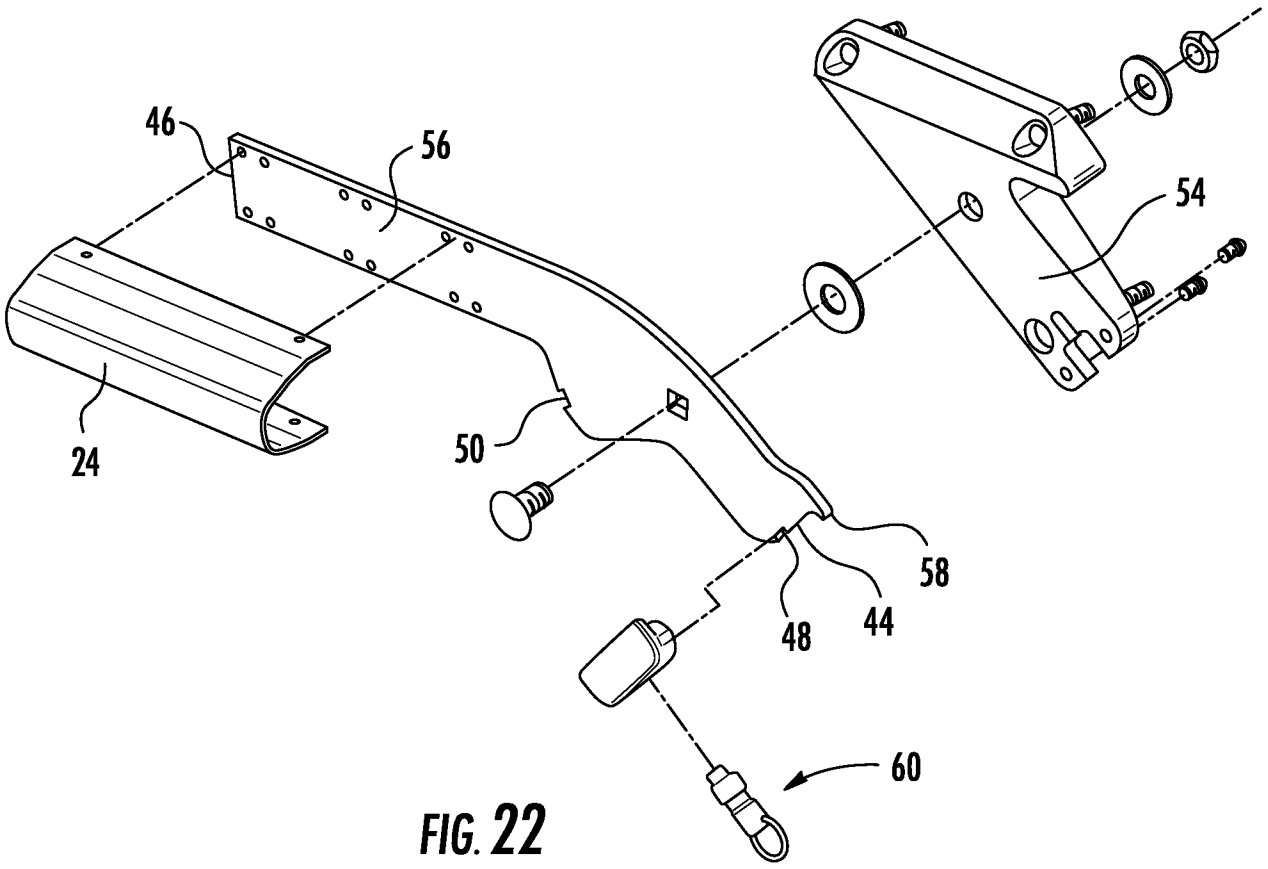
FIG. 22 is an alternate exploded perspective view of the rotation assembly of FIG. 21 according to another embodiment of the invention.
Figure 23:
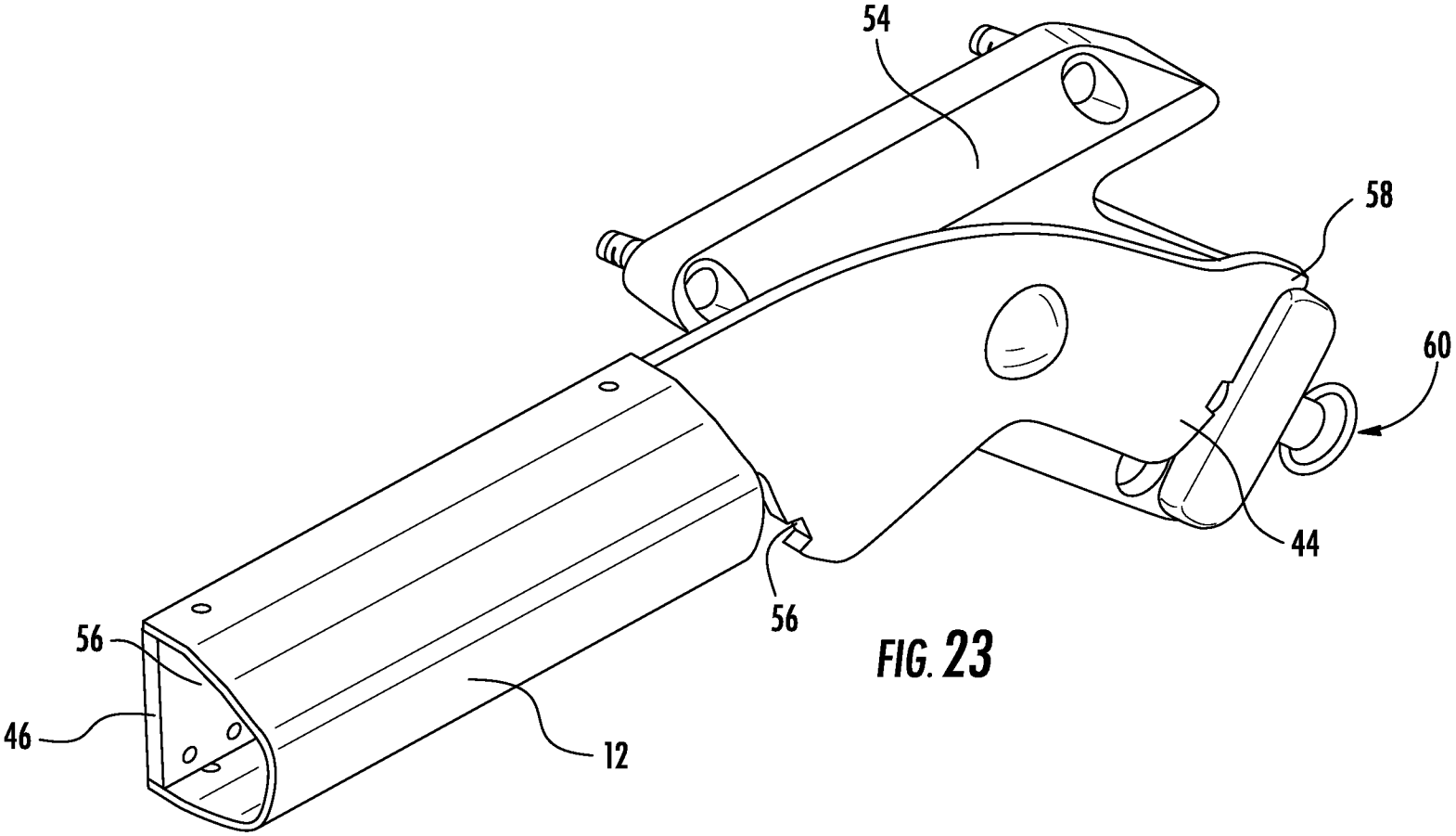
FIG. 23 is a perspective view of the assembly rotation assembly of FIGS. 21 and 22 according to another embodiment of the invention.
Figure 24:
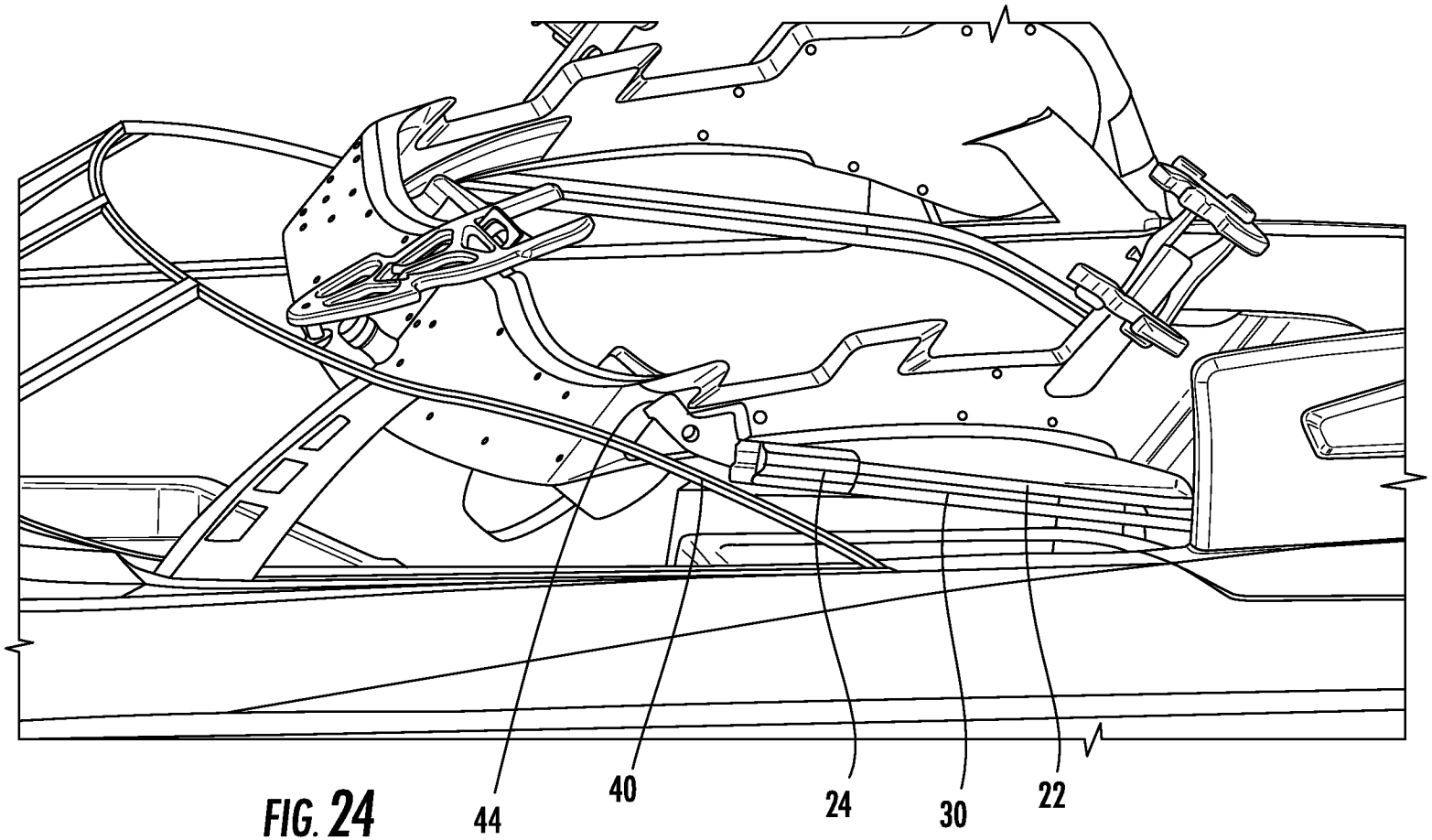
FIG. 24 is a side view of a watercraft having both a tower structure and a bimini top system arranged in a stowed configuration according to an embodiment of the invention.
Figure 25:
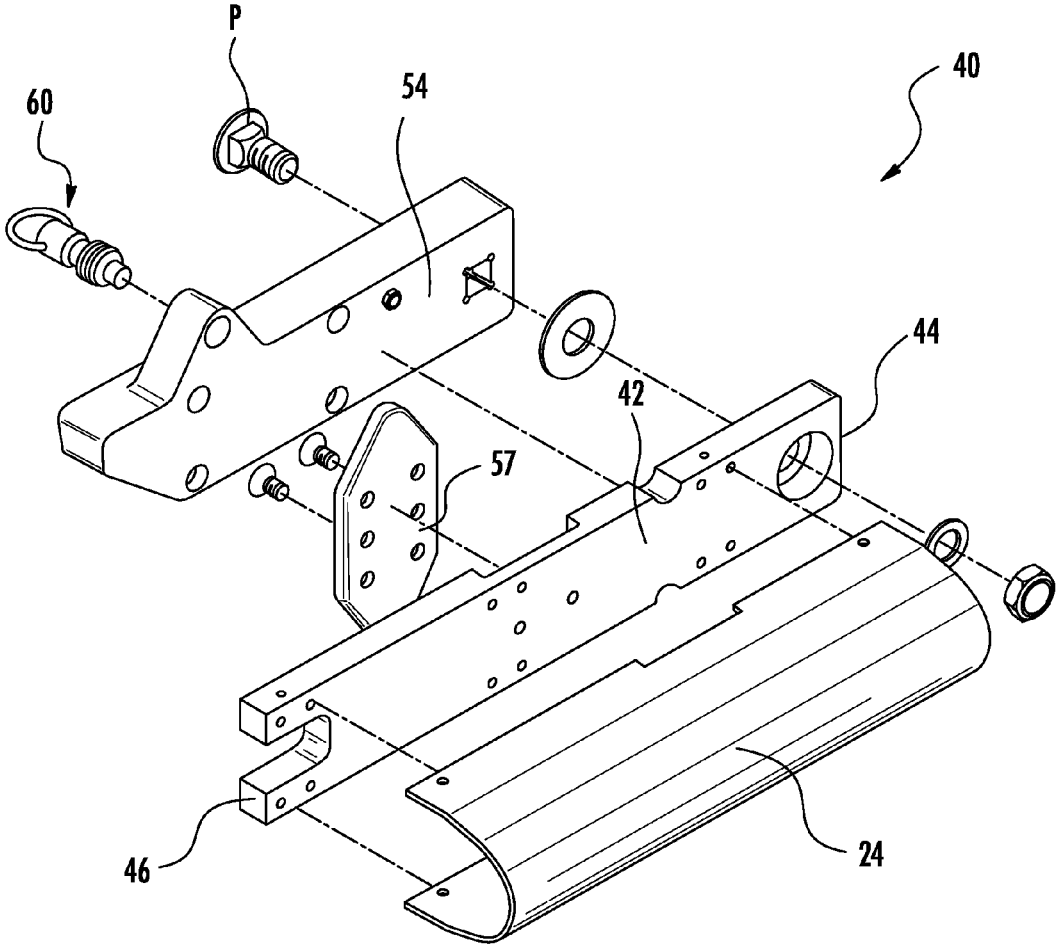
FIG. 25 is an exploded perspective view of another rotation assembly according to another embodiment of the invention.
Figure 26:
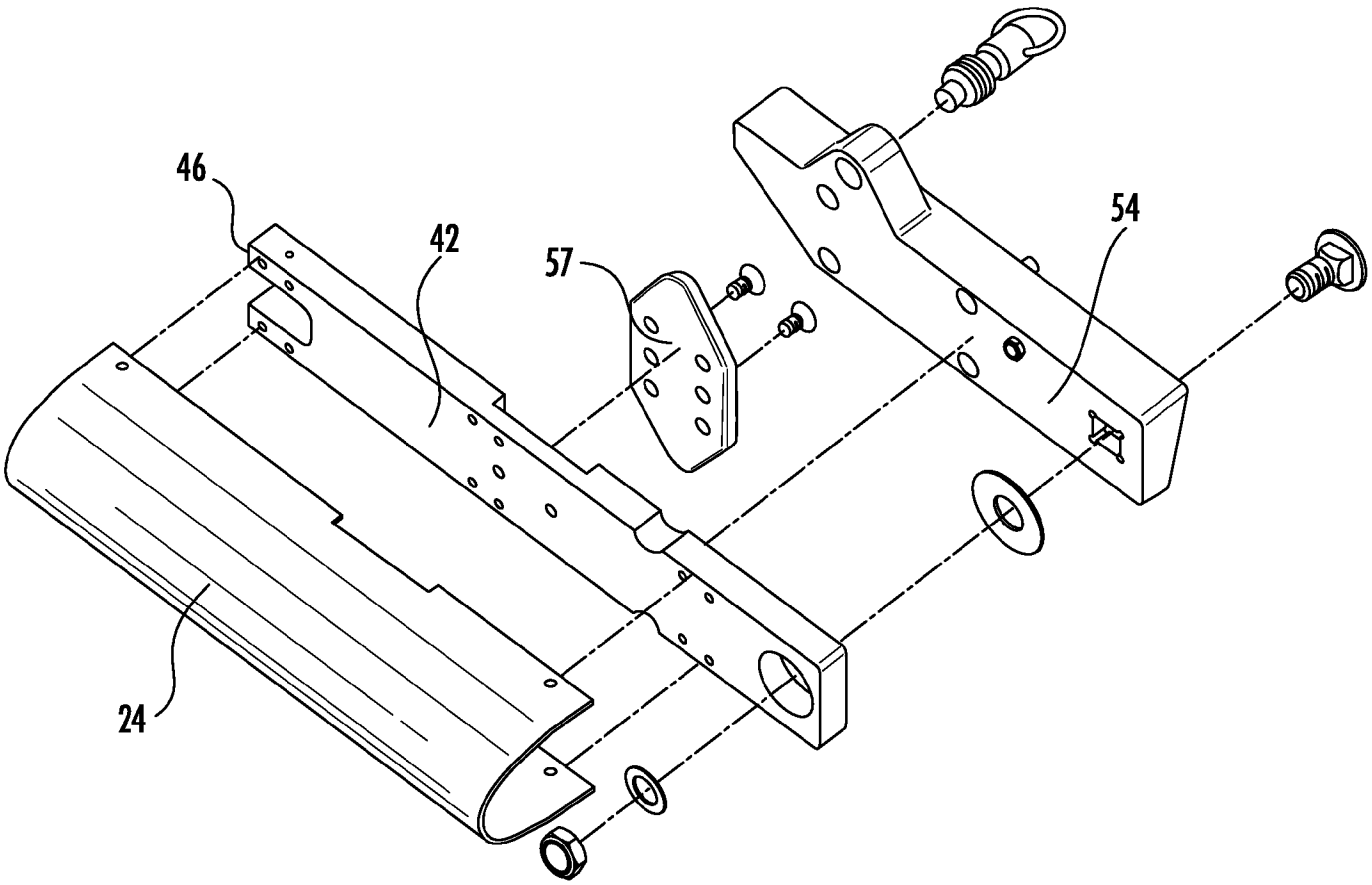
FIG. 26 is an alternate exploded perspective view of the rotation assembly of FIG. 25 according to another embodiment of the invention.
Figure 27:
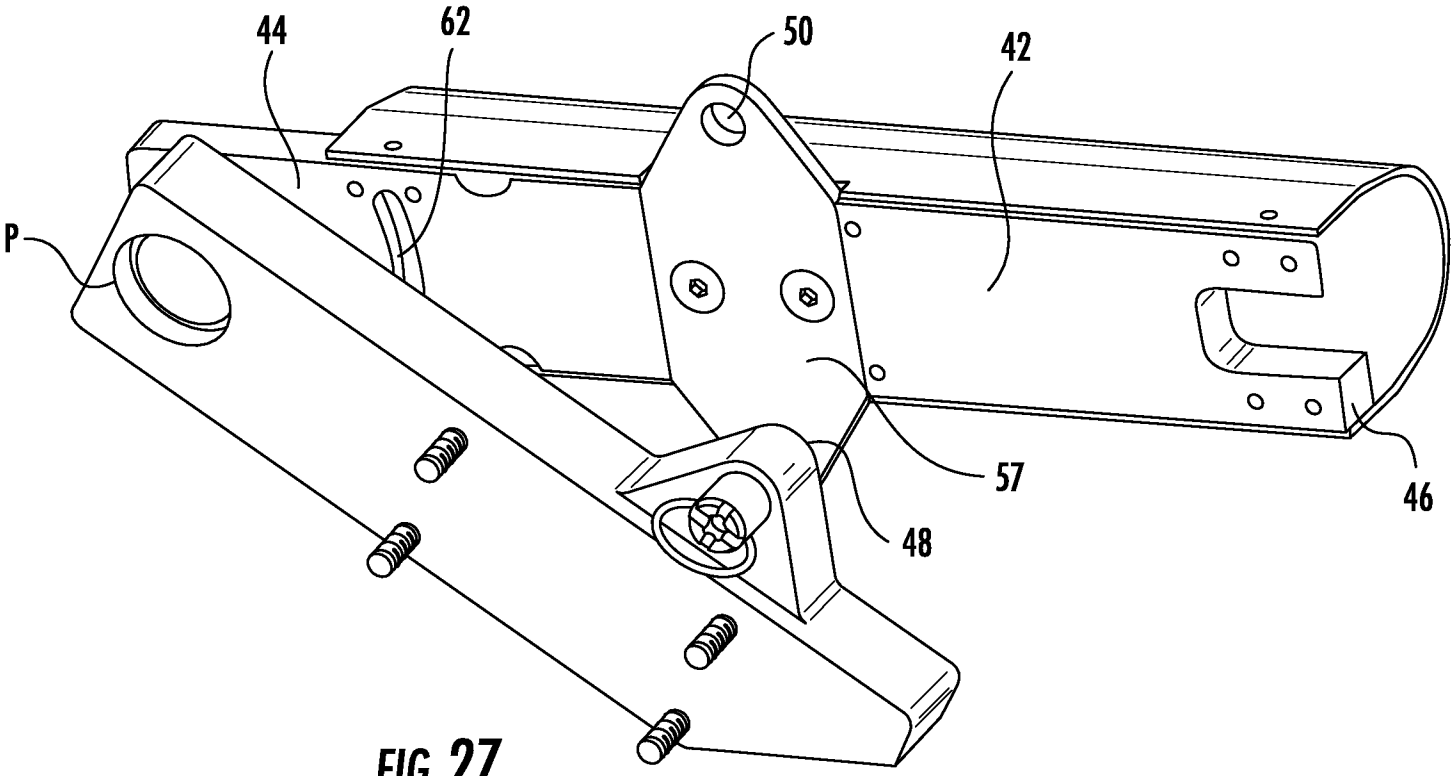
FIG. 27 is a perspective view of the assembly rotation assembly of FIGS. 25 and 26 according to another embodiment of the invention.
Figure 28:
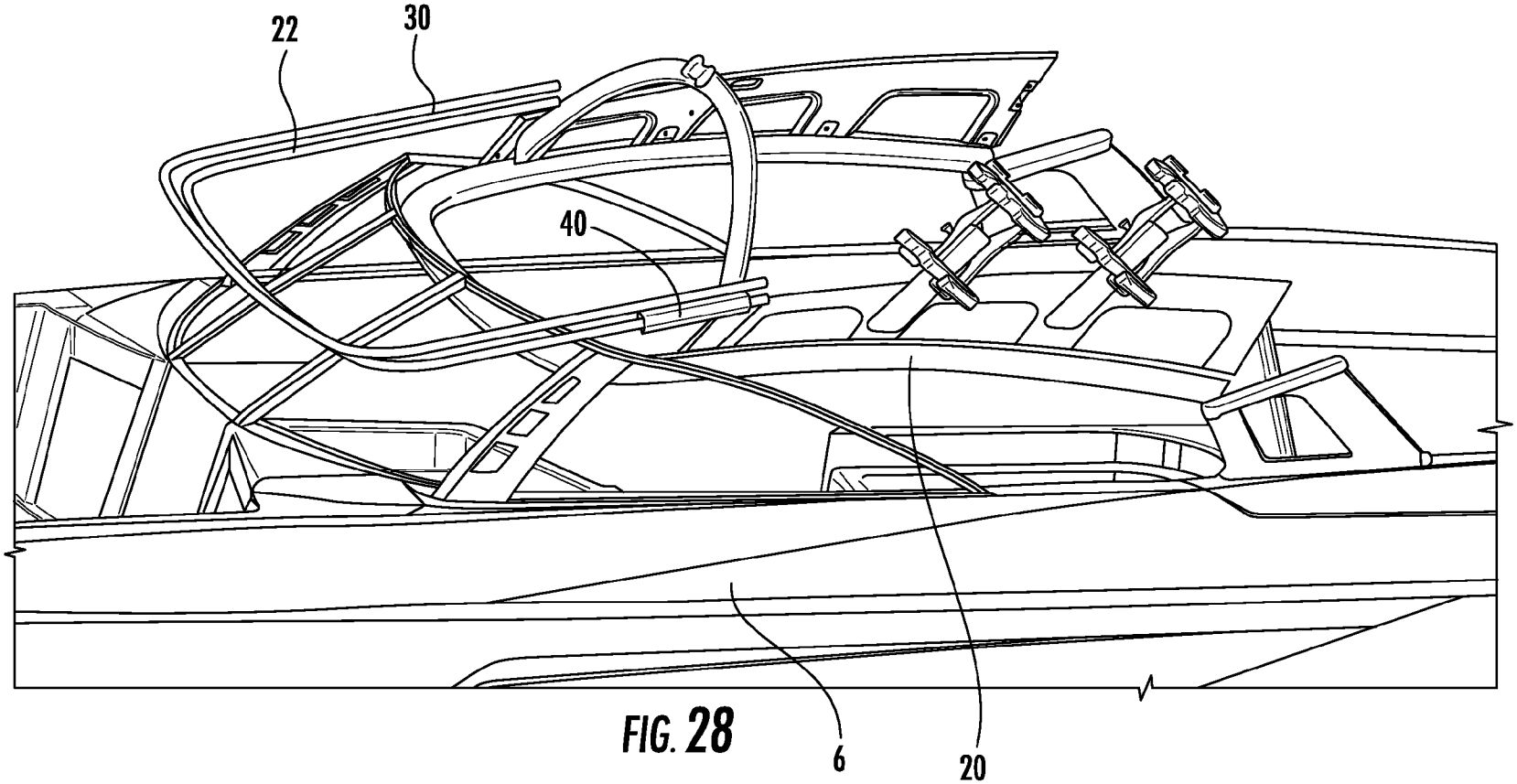
FIG. 28 is a side view of a watercraft having both a tower structure and a bimini top system arranged in a stowed configuration according to an embodiment of the invention.

The configuration of the assembly 40 may be selected based on the configuration of the tower structure 20 of the watercraft 6. In embodiments having a tower structure 20 as shown in FIGS. 13-24, the swing arm 40 is configured to rotate to a second positon where the frame 10 extends towards the watercraft 6 in an orientation generally parallel to the tower structure 20. In the illustrated, non-limiting embodiment of FIG. 19, when the swing arm 42 is in the second position, a front end of the frame 10 is arranged in contact with the tower structure 20, such as near an interface between the tower structure 20 and the watercraft 6. As is illustrated in FIGS. 20 and 24, the tower structure 20 may be configured to pivot or rotate relative to a portion of the watercraft 6, such as a deck thereof for example, for storage. By arranging the frame 10 in the second stowed position, parallel to the tower structure 20, the bimini top system 8 may be easily stowed with the tower structure 20, thus eliminating the need to remove the bimini top system 8 from the watercraft 6.

In other embodiments, such as illustrated in FIGS. 25-28, the clearance between the tower structure 20 and a windshield of the watercraft 6 is limited. As a result, the the frame 10 and swing arm 42 may be configured to rotate in an opposite direction relative to the mounting bracket 54. As shown, the swing arm 42 is configured to rotate clockwise about pin P between the first position and the second position. As a result, when the tower structure 20 is rotated to a storage position, the bimini top system 8, in the second position, is arranged generally horizontally and may extend over the windshield of the watercraft 6.

It should be noted that though portions 22, 30 the frame 10 are referred to as "front" and "back" respectively, these qualifiers are merely provided for descriptive purposes. In fact, the portions may be positioned in any desirable orientation relative to a front or back of a watercraft 6 on which the frame is mounted.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A swing arm for a stowable bimini frame associable with a tower structure of a watercraft, the swing arm comprising:

a body coupled to the bimini frame, the body being rotatable relative to an exposed surface of the tower structure between a first position and a second position; and an engagement mechanism for selectively engaging the body to retain the body in at least one of the first position and the second position;

wherein the body includes a first connector and a second connector, wherein when the body is in the first position, the engagement mechanism engages the first connector and when the body is in the second position, the engagement mechanism engages the second connector.

2. The swing arm according to claim 1, wherein the first connector and the second connector are substantially identical.

3. A stowable bimini top associable with a tower structure of a watercraft, the bimini frame comprising:

a first frame portion;

a second frame portion;

a hinge associating said first portion and said second portion, said second portion being foldable in a direction of said first portion via rotation about said hinge, wherein the bimini frame is rotatably coupled to an exposed surface of the tower structure between a first position and a second position, the bimini frame being coupled to the tower structure adjacent a distal end of the tower structure.

4. The stowable bimini top according to claim 3, further comprising a swing arm connected to at least one of the first frame portion and the second frame portion, the swing arm being rotatably mounted to the tower structure.

5. The stowable bimini top according to claim 4, further comprising an engagement mechanism that selectively engages the swing arm to retain the bimini frame in one of the first position and the second position.

6. The stowable bimini top according to claim 5, wherein the swing arm includes a first connector and a second connector, wherein when the bimini frame is in the first position, the engagement mechanism engages the first connector and when the bimini frame is in the second position, the engagement mechanism engages the second connector.

7. The bimini frame according to claim 5, wherein the engagement mechanism is configured to releasably lock the swing arm when the bimini frame is in first position and the second position.

8. The bimini frame according to claim 3, wherein when the bimini frame is in the first position relative to the tower structure, the bimini frame is in one of an open configuration, folded configuration, or a first stowed configuration.

9. The bimini frame according to 8, wherein when the bimini frame is in the second position, the bimini frame is in a second stowed configuration, offset from horizontal.

10. The bimini frame according to claim 9, wherein in the second position, the bimini frame is arranged generally parallel to the tower structure.

11. The bimini frame according to claim 4, wherein the first frame portion is arranged in sliding association with said swing arm via at least one frame association structure.

12. The bimini frame of claim 11, wherein said sliding association allows said bimini frame to be configured between a folded position, wherein a front end of said bimini frame is spaced from said tower structure and a stowed position, wherein said front end of said bimini frame is disposed adjacent said tower structure via a sliding of the bimini frame relative to said frame association.

13. The bimini frame of claim 3, wherein at least one of said first frame portion and said second frame portion are configured for attachment of a cover extending across at least one of said first frame portion and said second frame portion.

14. A bimini top system for a watercraft, the system comprising:

a tower structure extending the watercraft; and a stowable frame including a first frame portion and a second frame portion, the stowable frame being coupled to an exposed surface of the tower structure adjacent a distal end of the tower structure such that the stowable frame is rotatable relative to the tower structure between a first position and a second position.

15. The system according to claim 14, wherein the stowable frame is mounted to the tower structure via a swing arm.

16. The system according to claim 15, further comprising:

an engagement mechanism configured to cooperate with the stowable frame to releasably lock the stowable frame one of the first position and the second position.

17. The system according to claim 16, wherein the swing arm includes a first connector and a second connector, and when the stowable frame is in the first position, the first connector is operably coupled to the engagement mechanism and when the stowable frame is in the second position, the second connector is operably coupled to the engagement mechanism.

18. The system according to claim 17, wherein the engagement mechanism is a fastener and the first connector and the second connector are substantially identical slots formed in a first side of the arm.

19. The system according to claim 17, wherein the engagement mechanism is a spring pin.

20. The system according to claim 15, wherein said first frame portion is arranged in sliding association with said swing arm via at least one frame association structure, wherein said sliding association allows said stowable frame to transition between an openable position spaced from said tower structure and a stowable position disposed adjacent said tower structure via a sliding of the stowable frame relative to said frame association structure.

21. The system according to claim 15, wherein said stowable frame further includes a hinge associating said first portion and said second portion, said second portion being foldable in a direction of said first portion via rotation about said hinge, and when the stowable frame is in the first position, the stowable frame is arranged generally horizontally in one of an open configuration, folded configuration, or a first stowed configuration.

22. The system according to claim 15, wherein when the stowable frame is in the second position, the stowable frame is in a second stowed position, generally offset from horizontal.

23. The system according to claim 22, when the stowable frame is in the second position, the stowable frame is arranged generally parallel to the tower structure.

24. A method of stowing a bimini top mounted to a tower structure of a watercraft comprising:

unlocking a bimini top from a first position;

rotating the bimini top relative to the tower structure from the first position to a second position, the bimini top being rotatably coupled to an exposed surface of the tower structure adjacent a distal end of the tower structure.

25. The method according to claim 24, further comprising:

locking the bimini top in the second position.

26. The method of claim 25, further comprising rotating the tower structure relative to the watercraft.

* * * * *